US008606131B2

(12) United States Patent
Shibuya

(10) Patent No.: US 8,606,131 B2
(45) Date of Patent: Dec. 10, 2013

(54) CHARGING APPARATUS WITH AC AND DC CURRENT DETECTION

(75) Inventor: Kenichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 12/498,504

(22) Filed: Jul. 7, 2009

(65) Prior Publication Data

US 2010/0008685 A1 Jan. 14, 2010

(30) Foreign Application Priority Data

Jul. 8, 2008 (JP) ..... 2008-178505

(51) Int. Cl.
*G03G 15/02* (2006.01)

(52) U.S. Cl.
USPC ..... 399/50

(58) Field of Classification Search
USPC ..... 399/50, 89, 115
See application file for complete search history.

(56) References Cited

U.S. PATENT DOCUMENTS 6,363,134 B1 3/2002 Suzuki
6,868,241 B2 * 3/2005 Takami ..... 399/50
7,469,109 B2 12/2008 Shibuya
2007/0127939 A1 * 6/2007 Kitajima ..... 399/50
2008/0101809 A1 * 5/2008 Ida et al. ..... 399/50

FOREIGN PATENT DOCUMENTS

JP 2000-201921 A 7/2000
JP 2004-333789 A 11/2004

* cited by examiner

*Primary Examiner* — David Gray
*Assistant Examiner* — Milton Gonzalez
(74) *Attorney, Agent, or Firm* — Fitzpatrick, Cella, Harper & Scinto

(57) ABSTRACT

A charging device includes a charging member to charge an image bearing member; an applying device configured to apply to the charging member a charging bias voltage comprising a DC voltage component and an AC voltage component; an AC current detector; a DC current detector; and a controller. The controller determines a saturation peak-to-peak voltage V0 at which the detected DC current saturates when a peak-to-peak voltage of the AC voltage is increased, calculates a relational expression using only a detected AC current when a peak-to- peak voltage which is not more than the saturation peak-to-peak voltage V0 is applied, and determines the peak-to-peak voltage of the AC voltage applied to the charging member in an image forming operation on the basis of the relational expression and a detected AC current when a peak-to-peak voltage higher than the saturation peak-to-peak voltage V0 is applied.

2 Claims, 21 Drawing Sheets

CHARGING APPARATUS WITH AC AND DC CURRENT DETECTION

FIELD OF THE INVENTION AND RELATED ART

The present invention relates to a charging apparatus for charging a photosensitive member, in particular, a charging apparatus which is employed by an electrophotographic image forming apparatus, for example, a copying machine, a printer, a fax, a multifunction apparatus capable of two or more of the functions of the preceding apparatuses, etc.

There have been known various methods for charging the surface of the photosensitive member of an electrophotographic image forming apparatus. Among these charging methods, the charging method which applies oscillatory voltage made up of DC and AC voltages is superior in terms of the uniformity of charge. Hereafter, the methods for charging a photosensitive member by applying oscillatory voltage to a charging member will be referred to as "AC charging method".

However, the AC charging method has its own problems. One of the problems is as follows: The AC charging method is greater in the amount of the electrical discharge to a photosensitive member than the DC charging method. Therefore, the AC charging method tends to promote the deterioration, for example, shaving, of a photosensitive member. Further, the employment of the AC charging method sometimes resulted in the formation of abnormal images, for example, images suffering from the appearance of flowing water, because of the byproducts of electrical discharge, in an operational environment in which both temperature and humidity were high.

In order to improve the AC charging method in terms of this problem, it is necessary to minimize in amount the electrical discharge which alternately occurs toward positive and negative sides. In order to minimize in amount the electrical discharge, it is necessary to minimize the amount of voltage necessary to properly charge a photosensitive member.

In reality, however, the relation between voltage and the amount of the electrical discharge caused by the voltage is not always the same. That is, it is affected by the changes in the thickness of the photosensitive layer and inductive layer of a photosensitive member, changes in a charging member, changes of the air attributable to environmental changes, etc. For example, in an environment in which both temperature and humidity are low (L/L), the materials of a photosensitive member are dry, causing thereby the photosensitive member to increase in the resistance value, which in turn makes it difficult for electrical discharge to occur. Thus, in order to uniformly charge a photosensitive member, it is necessary for the peak-to-peak voltage to be higher than a certain value. However, keeping the peak-to-peak voltage higher than a certain value creates the following problem. That is, in a case where a charging operation is carried out in a high temperature-high humidity environment (H/H), with the charge voltage set so that its peak-to-peak voltage is higher than the preset value for ensuring a photosensitive member to be uniformly charged under the low temperature-low humidity (L/L) environment, the charging member causes more electrical discharge than necessary to properly charge the photosensitive member, because in the H/H environment, the materials for a photosensitive member and charging member absorb humidity, and therefore decrease in electrical resistance value. The increase in the amount of the electrical discharge causes various problems. For example, it causes an image forming apparatus to yield images which suffer from the appearance of flowing water, images which appear blurry, and the like. Further, it causes toner particles to melt and adhere to each other. Also, it reduces the service life of a photosensitive member, because it accelerates the deterioration of the peripheral surface of a photosensitive drum, accelerating thereby the shaving of the peripheral surface.

As the methods for preventing the electrical discharge from being made to fluctuate in amount by the environmental changes, there have been proposed the "AC voltage stabilizing controlling method" that keeps constant in value the AC voltage applied to a charge roller, and also, "AC current stabilizing control method" that controls in value the AC current which flows as the AC voltage is applied to a charging member. The AC current stabilizing control method makes it possible to control a charging apparatus so that in the L/L environment, that is, the environment in which the materials increase in electrical resistance, the AC charge voltage increases in the peak-to-peak voltage value, whereas in the H/H environment, that is, the environment in which the materials decrease in electrical resistance, the AC charge voltage decreases in the peak-to-peak voltage. Therefore, the AC current stabilizing control method can more effectively prevent the fluctuation in the amount of the electrical discharge than the AC voltage stabilizing control method.

However, from the standpoint of further prolonging the service life of a photosensitive member, even the AC current stabilizing control method cannot be said to be perfect, because it cannot completely prevent the fluctuation in the amount of electrical discharge, which is attributable to the nonuniformity in properties among charging members, which is attributable to manufacturing processes; charge roller contaminations; change in the electrostatic capacity of a photosensitive member; nonuniformity in properties among high voltage generating apparatuses for the main assembly of an image forming apparatus; etc. Thus, in order to perfectly prevent the electrical discharge between a charging member and a photosensitive member, from fluctuation in amount, various measures have to be taken to improve charging member manufacturing processes so that all charging members will be uniform in properties, to ensure that the operational environment for an image forming apparatus does not change in temperature and humidity, and to come up with a means for preventing a high voltage generating apparatus from fluctuating in output, which results in substantial cost increase.

Thus, there have been proposed various methods for uniformly charging a photosensitive member, which were intended to prevent such problems as the deterioration of a photosensitive member, thermal adhesion of toner particles to each other, formation of images with an appearance of flowing water, etc., by keeping the electrical discharge constant in amount by preventing the occurrence of excessive amount of electrical discharge, regardless of the nonuniformity in electrical resistance value among charging members, which are attributable to charging member manufacturing processes, and the change in electrical resistance value of a charging member, which is attributable to the changes in environmental factors.

For example, disclosed in Japanese Laid-open Patent Application 2000-201921 is the following method for determining the properties of the voltage to be applied to a charging means and the properties of the current to be flowed by the charging means. That is, a DC voltage is applied to a charging member, and discharge start voltage Vth is obtained. Then, a function between AC voltage and AC current is obtained at a point in the non-discharge range, that is, DC voltage range in which voltage is no higher than the charge start voltage Vh, and another function between AC voltage and AC current is obtained at a point in the discharge range, that is, the DC voltage range in which voltage is higher than the charge start voltage Vh. Then, the discharge current amount is obtained as the difference between the two functions, and the charging means is controlled so that the obtained discharge current amount remains stable.

Disclosed in Japanese Laid-open Patent Application 2004-333789 is the following method for obtaining the smallest amount of discharge necessary to uniformly charge a photosensitive member. That is, while applying AC voltage, the amount of DC current is measured to find the DC current saturation point in the AC electric field. Then, the AC voltage value which corresponds to this DC current saturation point is multiplied by a preset ratio, and the product is used as the value for the charge bias for an actual image forming operation.

However, in the case of the above-described method disclosed in Japanese Laid-open Patent Application 2001-201921, unless the discharge start voltage Vth obtained by applying the DC voltage is accurately known, it is impossible to precisely separate the discharge range from the non-discharge range.

FIG. 18 is a graph which shows the relationship between the DC voltage applied to a charging member to charge a photosensitive member A, and the measured amount of surface potential of the photosensitive member A, and the relationship between the DC voltage applied to the charging member to charge a photosensitive member B, which is different in material from the photosensitive member A, and the measured amount of surface potential of the photosensitive member B.

The following is evident from FIG. 18. That is, in the case of the photosensitive member A, as the DC voltage is increased, the surface potential remained at 0 V until the voltage reached a certain value. Then, from this point on, the surface potential of the photosensitive member A linearly increased. This value is the value of the Vth. On the other hand, in the case of the photosensitive member B, the surface potential gradually increases from the point where the DC voltage was 0 V, although the amount of increase was very small. Then, after the DC voltage reached a certain point, the surface potential of the photosensitive member B linearly increased.

The difference in properties between the two photosensitive members A and B is affected by the electrical resistance, capacity, and materials of the photosensitive members A and B, the electrical resistance, capacity, and materials of the charging member, and the environmental factors. Thus, there occur many situations in which the discharge start point Vth cannot be accurately obtained when DC voltage is applied.

Further, the method used by the apparatus disclosed in Japanese Laid-open Patent Application 2001-201921 is characterized in that the functions between the discharge range and non-discharge range are linear, and the difference between the two functions is calculated. However, the relationship between the peak-to-peak voltage and AC current is not linear at all. That is, referring to FIG. 19, as the peak-to-peak voltage is continuously increased beyond a certain value, the AC current tends to increase with accelerated rates compared to the rate with which the peak-to-peak voltage is increased. It became evident from the results of intensive studies that this phenomenon occurs because the discharge nip between the charging member and photosensitive member increases in size as the AC voltage is increased in peak-to-peak voltage.

Thus, in order to compare the discharge current amount in the discharge range and that in the non-discharge range in terms of linear function, the value of the peak-to-peak voltage of the AC voltage to obtain the amount of discharge current in the discharge range is desired to be as close as possible the value of the peak-to-peak voltage of the discharge start voltage. Further, using such a value for the peak-to-peak voltage makes it possible to accurately and easily obtain the desired amount of discharge current. Japanese Laid-open Application No. 2001-201921 does not referred to this matter.

FIG. 20 is a graph which shows the relationship between peak-to-peak voltage and AC current, which was obtained, with the use of a combination of a charging member and a photosensitive member, at the time when recording medium began to be conveyed, and that obtained with the use of the same combination of a charging member and a photosensitive member, after a certain number of recording mediums were conveyed, in the case where the discharge start point was accurately found using the method disclosed in Japanese Laid-open Patent Application No. 2004-333789.

In the case where the value of the peak-to-peak voltage at the discharge start point is multiplied with a preset ratio of 1.15, the amount of discharge current was substantially greater after a certain number of recording mediums were conveyed, and therefore the rate of the AC current had substantially increased, than at the time when the recording medium conveyance was started. The relationship between AC voltage and AC current in terms of the rate with which they change is affected by various factors, such as the change in the film thickness of a photosensitive member, change in the operational environment of an image forming apparatus, cumulative image formation count, etc. Therefore, it is difficult to take all of these factors into consideration in order to accurately determine the relationship between the AC voltage and AC current. Therefore, it is difficult to maintain an accurate amount of discharge current with the use of the method which multiplies the peak-to-peak voltage at the discharge start point by a preset ratio.

SUMMARY OF THE INVENTION

One of the primary objects of the present invention is to provide a charging apparatus which is significantly smaller than a conventional charging apparatus, in the amount of the damages to which a photosensitive member is subjected when the photosensitive member is charged by a charging apparatus.

According to an aspect of the present invention, there is provided a charging apparatus, comprising a charging device for electrically charging a photosensitive member; a bias applying device for applying to said charging member a charging bias voltage comprising a DC voltage component and an AC voltage component, wherein said bias applying device effect a constant voltage control with a constant AC component of the charging bias voltage; an AC detector for detecting an AC detected current when said charging member is supplied with a test bias voltage; a DC detector for detecting a DC detected current when said charging member is supplied with the test bias voltage; and a controller for controlling a charging bias voltage to be applied to said charging member; wherein said control means determines a peak-to-peak voltage Vo when a change rate of detected DC current provided by sequentially applying the test bias voltages having different peak-to-peak voltages in order of increasing or decreasing peak-to-peak voltage becomes not more than a predetermined level, and said control means sets a peak-to-peak voltage of the charging bias voltage on the basis of a detected AC current when a peak-to-peak voltage Vp larger than the peak-to-peak voltage Vo and a detected AC current when a peak-to-peak voltage Vq not larger than the peak-to-peak voltage Vo.

According to another aspect of the present invention, there is provided a charging apparatus, comprising a charging device for electrically charging a photosensitive member; a bias applying device for applying to said charging member a charging bias voltage comprising a DC voltage component and an AC voltage component, wherein said bias applying device effects a constant current control with a constant AC component of the charging bias voltage; an AC detector for detecting a peak-to-peak voltage of the AC component when a test bias voltage is applied to said charging member; an AC detector for detecting an AC detected current when said charging member is supplied with the test bias voltage; and a controller for controlling a charging bias voltage to be applied to said charging member; wherein said control means determines an AC current Io when a change rate of detected DC current provided by sequentially applying the test bias voltages having different AC currents in order of increasing or decreasing AC current becomes not more than a predetermined level, and said control means sets an AC current of the charging bias voltage on the basis of a detected peak-to-peak voltage when an AC current Ip larger than the AC current Io and a detected peak-to-peak voltage when an AC current Iq not larger than the AC current Io.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, a charging apparatus in accordance with the present invention, and an image forming apparatus which has the charging apparatus in accordance with the present invention, will be described in more detail with reference to the appended drawings.

(Embodiment 1)

Figure 1:
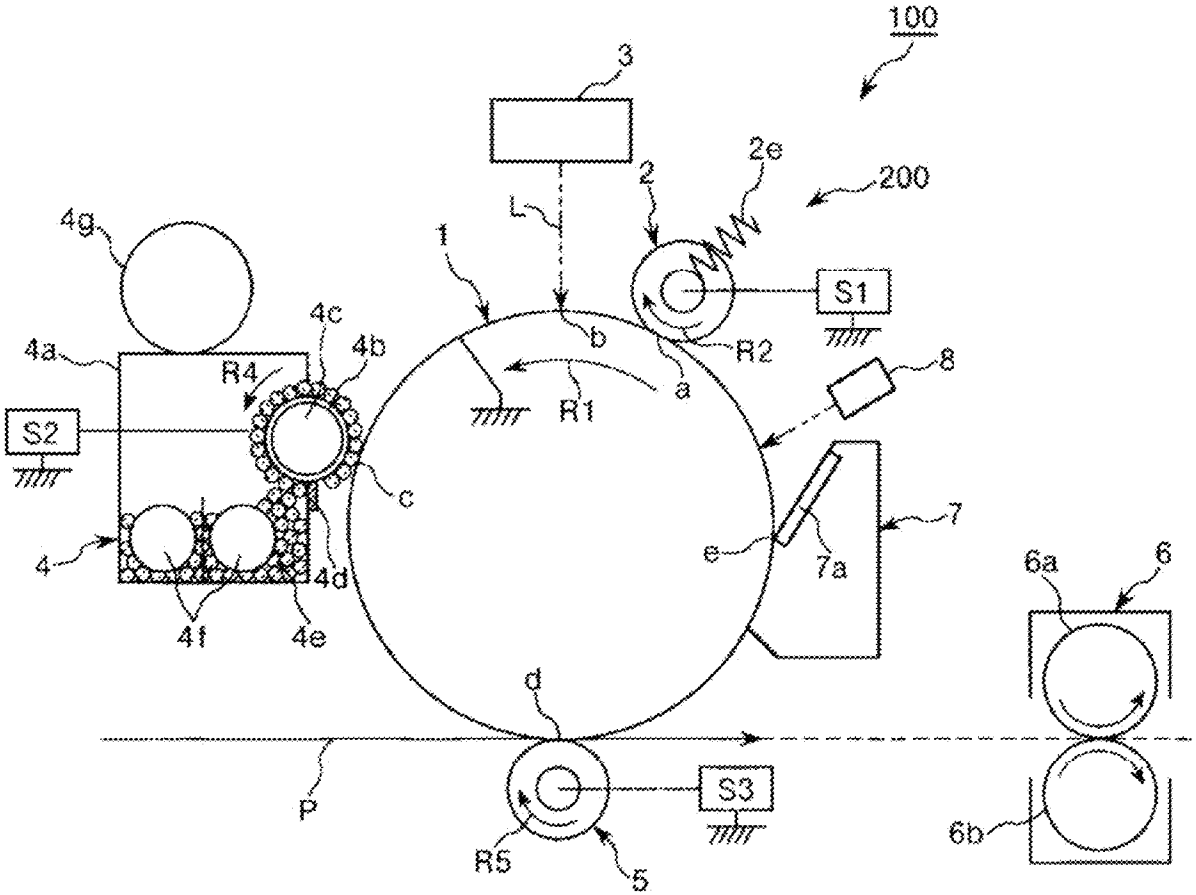
FIG. 1 is a schematic sectional view of the image forming apparatus in the first preferred embodiment of the present invention, and shows the general structure of the apparatus.

FIG. 1 is a vertical sectional view of the image forming apparatus in the first preferred embodiment of the present invention, and shows the general structure of the apparatus. The image forming apparatus 100 in this embodiment is a laser beam printer which uses one of the electrophotographic processes of the transfer type. The laser beam printer uses a charging method of the contact type, and a developing method of the reversal type. The largest sheet of recording medium usable with (passable through) this printer is A3 in size.

The image forming apparatus 100 in this embodiment is provided with an electrophotographic photosensitive member 1, as an image bearing member, which is in the form of a drum, (which hereafter may be referred to as "photosensitive drum"). The image forming apparatus 100 is also provided with a charge roller 2, a developing apparatus 4, a transfer roller 5, and a cleaning apparatus 7, which are disposed in the adjacencies of the peripheral surface of the photosensitive drum 1, listing from the upstream side in terms of the rotational direction R1 (counterclockwise direction) of the photosensitive drum 1. The charge roller 2 is a part of a charging apparatus 200. The transfer roller 5 is a charging member of the contact type. The image forming apparatus 100 is also provided with an exposing apparatus 3, which is disposed above the roughly mid point between the developing apparatus 4 and charge roller 2. Further, the image forming apparatus 100 is provided with a fixing apparatus 6, which is on the downstream side of the transfer portion d (which is interface between photosensitive drum 1 and transfer roller 5), in terms of the recording medium conveyance direction.

Figure 2:
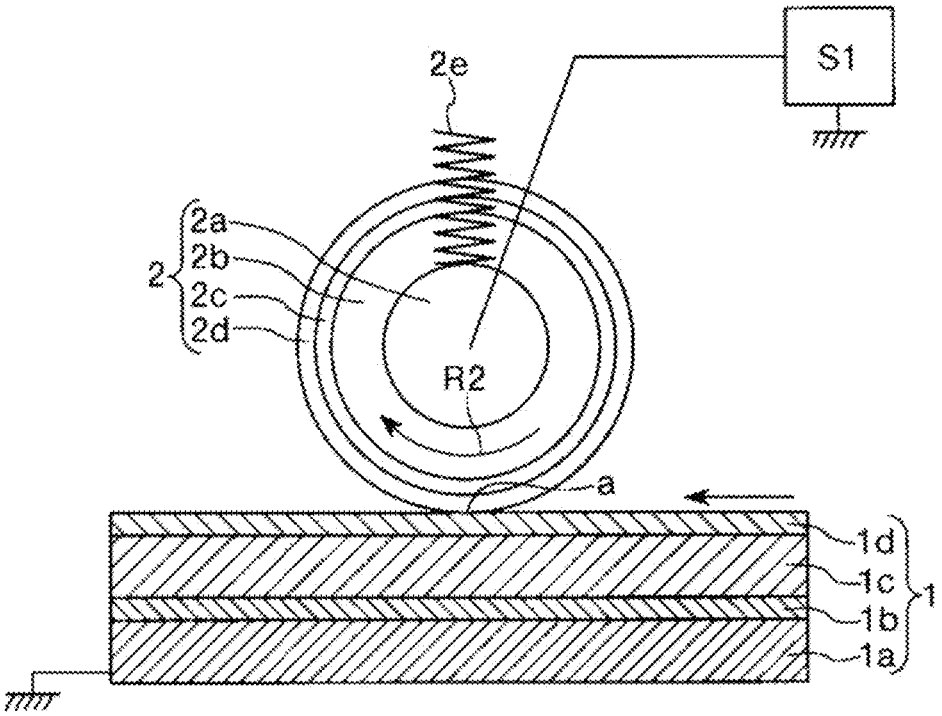
FIG. 2 is a schematic sectional view of the surface layers of the photosensitive drum, and charge roller, in the first embodiment, and shows their laminar structures.

The photosensitive drum 1 is an organic photosensitive member (OPC). It is 30 mm in external diameter, and is negatively charged. It is rotationally driven by a driving apparatus (unshown) at a process speed (peripheral velocity) of 210 mm in the direction (counterclockwise direction) indicated by an arrow mark R1. Referring to FIG. 2, the photosensitive drum 1 is made up of an aluminum cylinder 1*a* (electrically conductive substrate); an undercoat layer 1*b* coated on the peripheral surface of the photosensitive drum 1 to prevent the optical interference and to improve the adhesion of the upper layer to the aluminum cylinder 1*a*; an optical charge generation layer 1*c*; and a charge transfer layer 1*d*. The three layers are coated in layers in the listed order on the aluminum cylinder 1*a*.

The charge roller 2 is rotationally supported at the lengthwise end portions of its metallic core 2*a*, by a pair of bearings (unshown), one for one. It is kept pressed toward the center of the photosensitive drum 1 by a pair of compression springs 2*e* so that a preset amount of contact pressure is maintained between the peripheral surface of the photosensitive drum 1 and peripheral surface of the charge roller 2. As the photosensitive drum 1 is rotationally driven, the charge roller 2 is rotated by the rotation of the photosensitive drum 1 in the clockwise direction indicated by an arrow mark R2. The contact nip formed between the photosensitive drum 1 and charge roller 2 is the charging portion a (charging nip).

As a charge bias voltage, which is under a specific condition, is applied to the metallic core 2*a* of the charge roller 2 from an electrical power source S1, the peripheral surface of the photosensitive drum 1 is charged to preset polarity and potential level by the charge roller 2, which is in contact with the photosensitive drum 1. In this embodiment, the charge bias voltage applied to the charge roller 2 is an oscillatory voltage which is a combination of a DC voltage (Vdc) and an alternating voltage (AC), more specifically, −1,500 V of DC voltage, and an AC voltage which is 2 kHz in frequency. As a result, the peripheral surface of the photosensitive drum 1 is uniformly charged to −500 V (dark voltage level Vd) by the charge roller 2, which is in contact with the peripheral surface of the photosensitive drum 1.

The charge roller 2 is 320 mm in length. It has the metallic core 2*a* (substrate), and three layers 2*b* (bottom layer), 2*c* (intermediary layer), and 2*d* (surface layer), which cover the metallic core 2*a* in the listed order. The bottom layer 2*b* is formed of foamed sponge, and is for reducing the charging noises. The surface layer 2*d* is a protective layer provided to prevent leak even if the photosensitive drum 1 has a defect, such as a pin hole or the like.

More concretely, the specifications of the charge roller 2 in this embodiment are as follows:

metallic core 2*a:* stainless steel rod with a diameter of 6 mm;

bottom layer 2*b*: foamed rubber (NBR) in which carbon particles have been dispersed, and which is 0.5 g/cm$^2$ in specific gravity, $10^2$-$10^9$ Ω.cm in volume resistivity; and 3.0 mm in thickness; and intermediary layer 2*c*: fluorinated "Torejin" resin in which tin oxide and carbon particles have been dispersed, and which is $10^7$-$10^{10}$ Ω.cm in volume resistivity, 1.5 μm in in surface roughness (10 point average surface roughness Ra in JIS), and 10 μm in thickness.

This embodiment employs such a charging method that charges a photosensitive member by placing a charge roller in contact with the photosensitive drum. However, this is not mandatory. That is, for example, such a method that charges a photosensitive member with the presence of a gap (several tens of micrometers) between a charge roller and a photosensitive member may be employed. In the latter case, all that is necessary is that the gap size falls within the discharge-possible range, which is determined by the gap voltage and the air density (Paschen's law). As long as this requirement is met, the latter can charge a photosensitive drum just as well as the charging method used in this embodiment.

The exposing apparatus 3 in this embodiment is a laser beam scanner which uses a semiconductor laser. The laser beam scanner 3 exposes a portion (point) of the uniformly charged portion of the peripheral surface of the photosensitive drum 1, at the exposure position (point) b, by outputting a beam of laser light L in a manner to scan the peripheral surface of the photosensitive drum 1 while modulating the beam with the image signals inputted from an unshown host apparatus, such as an image reader or the like. As a given portion (point) of the peripheral surface of the photosensitive drum 1 is exposed to the beam of laser light, this portion (point) reduces in potential. Thus, as the peripheral surface of the photosensitive drum 1 is scanned by the beam of laser light L, an electrostatic latent image, which reflects the image information with which the beam of laser light L is modulated, is formed line by line.

The developing apparatus 4 in this embodiment is such a developing apparatus that develops in reverse the electrostatic latent image with the use of a developing method which uses two-component magnetic brush. It reversely develops the electrostatic latent image on the photosensitive drum 1; it deposits toner on the exposed (light) portions (points) of the peripheral surface of the photosensitive drum 1. That is, the developing apparatus 4 makes the electrostatic latent image visible by supplying the electrostatic latent image with toner.

This developing apparatus 4 is provided with a nonmagnetic development sleeve 4*b*, which is rotatably disposed in the developing means container 4*a* so that the development sleeve 4*b* is exposed through an opening of the container 4*a*. The developer 4*e* (toner) in the developing means container 4*a* is coated in a thin layer on the peripheral surface of the development sleeve 4*b*. The coated layer of developer 4*e* is conveyed by the rotation of the development sleeve 4*b* to the development portion c where the distance between the peripheral surface of the development sleeve 4*b* and the peripheral surface of the photosensitive drum 1 is smallest. The developer 4*e* in the developing means container 4*a* is a mixture of toner and magnetic carrier, and is conveyed toward the development sleeve 4*b* by the rotation of two developer stirring members 4*f* while being stirred by the stirring members 4*f*.

The electrical resistance of the magnetic carrier in this embodiment is roughly $10^{13}$ Ω.cm, and its particle diameter is 40 μm. The toner becomes negatively charged as it is rubbed by the magnetic carrier. The toner density in the developing means container 4*a* is detected by a density sensor (unshown), and the toner density in the developing means container 4*a* is kept constant by supplying the developing means container 4*a* with a proper amount of toner from a toner hopper 4*g*, based on the detected toner density in the container 4*a*.

The development sleeve 4*b* is positioned so that the smallest distance between its peripheral surface and the peripheral surface of the photosensitive drum 1 is 300 μm. It is rotationally driven in the direction indicated by an arrow mark R4 so that the movement of its peripheral surface in the developing portion c becomes opposite to the rotational direction R1 (counterclockwise direction) of the peripheral surface of the photosensitive drum 1 in the developing portion c.

A preset development bias is applied to the development sleeve 4*b* from an electric power source S2. The development bias applied to the development sleeve 4*b* in this embodiment is an oscillatory voltage, which is a combination of DC voltage (Vdc) and AC voltage (Vac), more specifically, the combination of −350 V of DC voltage, and an AC voltage which is 8 kV in peak-to-peak voltage.

The transfer roller 5 is kept pressed upon the photosensitive drum 1, with the application of a preset amount of pressure, forming thereby a transfer portion d. It rotates in the clockwise direction R5. To the transfer roller 5, a transfer bias (which is positive bias, being therefore opposite in polarity to the normal polarity, that is, the negative polarity, to which toner is charged). By the application of this transfer bias, a toner image on the peripheral surface of the photosensitive drum 1 is transferred onto a sheet of recording medium P, such as paper, as the second image bearing member, in the transfer portion d.

The fixing apparatus 6 has a fixation roller 6*a* and a pressure roller 6*b*, which are rotatable as necessary. After the transfer of the toner image from the photosensitive drum 1 onto the surface of the recording medium P, the recording medium P is conveyed through the fixation nip formed between the fixation roller 6*a* and pressure roller 6*b*. While the recording medium P is conveyed through the fixation nip, the toner image is thermally fixed with the heat and pressure from the fixation roller 6*a* and pressure roller 6*b*.

After the transfer of a toner image from the surface of the photosensitive drum 1 onto the recording medium P, the peripheral surface of the photosensitive drum 1 is cleaned by the cleaning apparatus 7. To describe more concretely, the peripheral surface of the photosensitive drum 1 is rubbed by the cleaning blade 7*a* of the cleaning apparatus 7, in the cleaning portion e, that is, the point of contact between the cleaning blade 7*a* and the peripheral surface of the photosensitive drum 1, being thereby cleared of the toner remaining on the peripheral surface of the peripheral surface of the photosensitive drum 1. After the cleaning of the peripheral surface of the photosensitive drum 1, the photosensitive drum 1 is used for forming the next portion of the image, or the next image; the photosensitive drum 1 is repeatedly used for image formation.

A pre-exposing means 8 (charge removing optical means) removes the electric charge remaining on the peripheral surface of the photosensitive drum 1 after the cleaning of the peripheral surface of the photosensitive drum 1, by irradiating the peripheral surface of the photosensitive drum 1 with light, so that the cleaned portion of the peripheral surface of the photosensitive drum 1 becomes virtually zero in potential before it is charged again.

Figure 3:
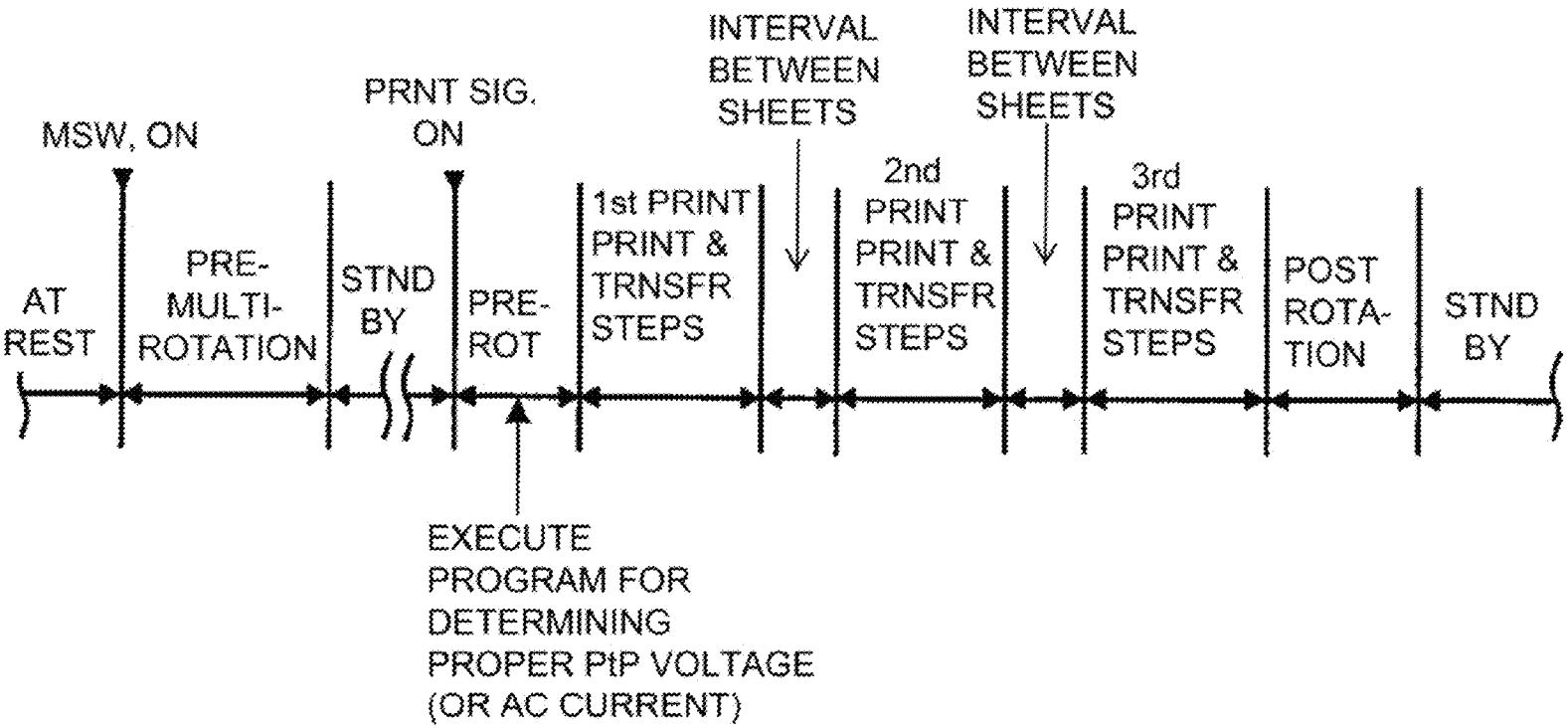
FIG. 3 is a diagram of the operational sequence of the image forming apparatus.

FIG. 3 is a diagram of the operational sequence of the above described printer.

a. Initial Rotation Step (Preliminary Multiple Rotation Step)

The initial rotation step is the step (warm-up step) which is carried out immediately after the printer is turned on. That is, as the electric power source switch of the printer is turned on, the various processing devices of the printer are made to prepare themselves for image formation; for example, the photosensitive drum 1 is rotationally driven for a preset length of time, and the fixation roller of the fixing apparatus is increased in temperature to a preset level.

b. Preparatory Rotation Step (Preliminary Rotation Step)

The preparatory rotation step is the rotation step between the end of the initial rotation step and when an actual image forming step (printing step) begins to be carried out. In a case where a printing signal is inputted during the initial rotation step, an image forming operation is started as soon as the initialization rotation step ends. In a case where no print signal is inputted during the initialization rotation step, the main motor is temporarily stopped after the ending of the initialization rotation step, and the rotational driving of the photosensitive drum 1 is stopped. Then, the printer is kept on standby until a printing signal is inputted. As a printing signal is inputted, the preparatory rotation is carried out.

In this embodiment, it is in this preparatory rotation step that the program for computing and determining the proper value for the peak-to-peak value (AC current value) for the AC voltage to be applied in the charging step of the image forming operation, is carried out. This subject will be described later in more detail.

c. Printing Step (Image Formation Step)

As soon as the preset preparatory rotation step ends, the printing step, that is, the step for forming an image on the rotating photosensitive drum 1 is started. In the printing step, a toner image is formed on the peripheral surface of the rotating photosensitive drum 1; the toner image is transferred onto the recording medium; the toner image is fixed by the fixing apparatus; and the print is discharged from the printer.

When the printer is in the continuous printing mode, the above described printing sequence is repeated until a preset number (n) of prints are outputted.

d. Paper Interval

The paper interval is the period between when the trailing edge of a given sheet of recording medium passes the transfer portion d, and when the leading edge of the following sheet of recording medium reaches the transfer portion d, while the printer is in the continuous recording mode, that is, the period in which no sheet of recording medium is being passed through the transfer portion d.

e. Post-rotation Step

The post-rotation step is the step in which the driving of the main motor is continued for a while to rotationally drive the photosensitive drum 1, and also, to carry out preset post-operations, after the printing step for the last sheet of recording medium is completed.

f. Standby Step

As soon as the post-rotation step is completed, the rotation of the main motor is stopped, stopping thereby the rotational driving of the photosensitive drum 1, and then, the printer is kept on standby until the next print start signal is inputted.

In a case where only a single copy is to be made, the printer is put through the post-rotation step after the completion of the printing of the single copy. Then, it is kept on standby after the completion of the post-rotation step.

If it happens that a print start signal is inputted while the printer is kept on standby, the printer begins the pre-rotation step.

The period in which the printer is performing the step c is the image formation period, and the initial rotation step (a), preparatory rotation step (b), paper interval (d), and post-rotation step (e) are the periods in which no image is formed.

Figure 4:
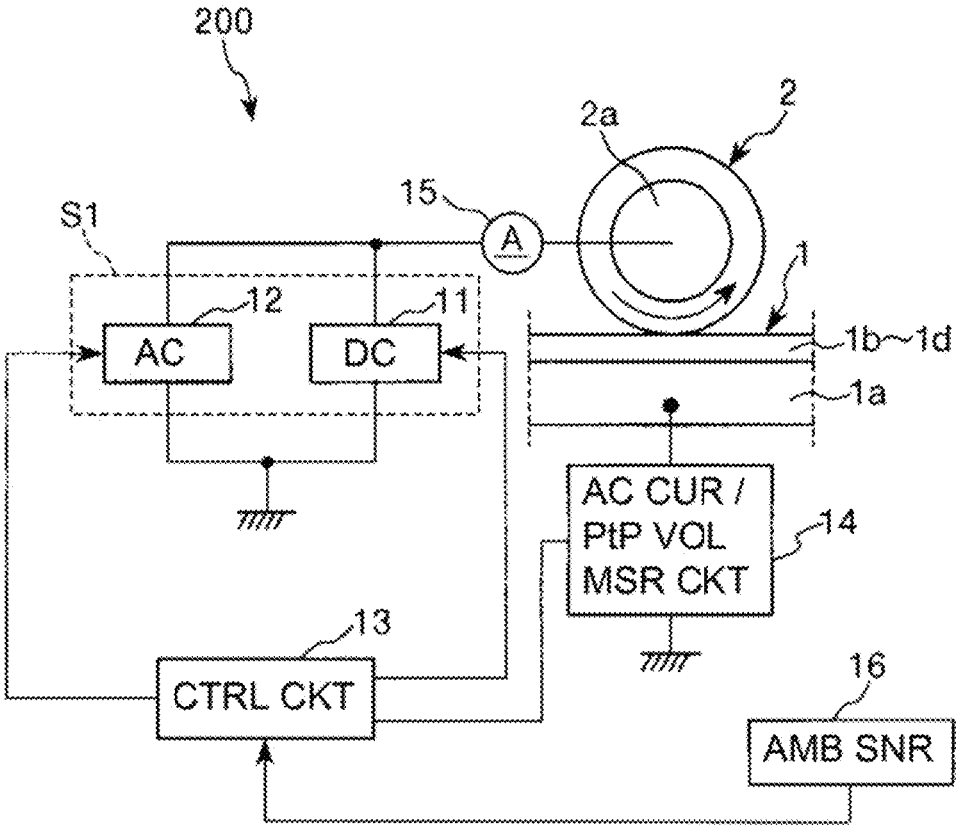
FIG. 4 is a block diagram of the charge bias applying system.

FIG. 4 is a block diagram of the circuit for applying the charge voltage to the charge roller 2, and shows the general structure of the charging apparatus 200.

As a preset oscillatory voltage (bias voltage (Vdc+Vac)), which is a combination of a DC voltage, and an AC voltage (with a frequency f) is applied to the charge roller 2 through the metallic core 2*a*, the peripheral surface of the rotating photosensitive drum 1 is charged to a preset potential level.

An electric power source S1, which is the means for applying voltage to the charge roller 2, has both an electric power source 11 (DC power source) and an electric power source 12 (AC power source).

A control circuit 13, which is a controlling means, has the function of controlling the abovementioned DC power source 11 and AC power source 12 of the electric power source S1 so that one of the DC and AC voltage is applied to the charge roller 2, or both voltages are applied at the same time to the charge roller 2. The control circuit 13 has also the function of controlling in value the DC voltage applied to the charge roller 2 from the DC power source 11, and the peak-to-peak voltage of the AC voltage applied to the charge roller 2 from the AC power source 12.

A measurement circuit 14 is a circuit used as the means for measuring value of the AC component of the AC current which flows to the charge roller 2 from the power source S1. The information regarding the AC current value (or peak-to-peak voltage) measured by this circuit 14 is inputted to the above described control circuit 13.

The measurement circuit 15 is a DC current detecting means for detecting the value of the DC component which flows from the power source S1 to the charge roller 2. The information regarding the DC current value detected by this circuit 15 is inputted to the above described control circuit 13.

The environment sensor 16 is an environment sensor used as the means for detecting the conditions of the environment in which the printer is set up. It is a combination of a thermometer and a hygrometer. The information regarding the operational environment of the printer is inputted to the above-mentioned control circuit 13 from this environment sensor 16.

That is, the control circuit 13 obtains the information regarding the AC current value (or peak-to-peak voltage value) from the measurement circuit 14; the information regarding the DC current value from the DC current measurement circuit 15; and the environmental information from the environment sensor 16. The control circuit 13 has the function of carrying out the program for computing and determining the proper peak-to-peak value for the AC voltage applied to the charge roller 2 in the charging step in the printing step.

Next, the method for controlling the AC bias applied to the charge roller 2 during the printing operation will be described.

The inventors of the present invention discovered through various studies that the discharge current amount numerated according to the following definition can be used as a substitute for the actual amount of AC discharge, and also that there is a strong relationship between this discharge current amount and the shaving of photosensitive drum, formation of an image having the appearance of flowing water, and level of uniformity with which a photosensitive member is charged.

Figure 5:
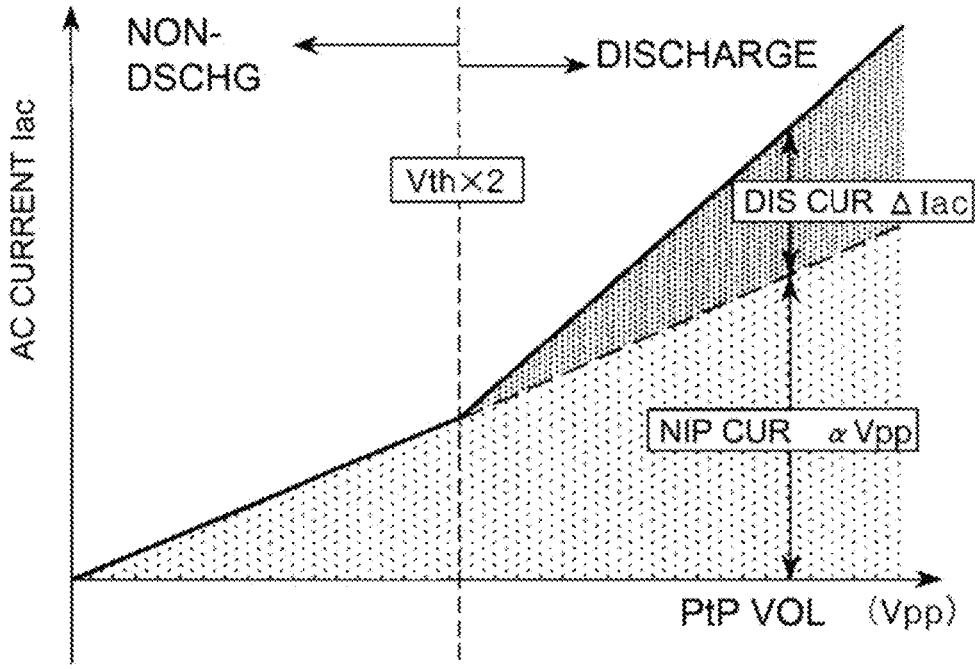
FIG. 5 is a graph showing the results of the measurements of the discharge current amount.

That is, referring to FIG. 5, when the value of the peak-to-peak voltage Vpp is no more than the discharge start voltage Vth×2 (V) (when peak-to-peak voltage in no discharge range), there is a linear relationship between the value of the peak-to-peak voltage and the value of the AC current Iac. However, as the peak-to-peak voltage value increases past the discharge start voltage Vth×2, that is, as the peak-to-peak voltage increases into the discharge range, the relationship shifts in such a direction that the discharge current Iac increases faster than in the non-discharge range. However, in the case of a similar experiment conducted in the vacuum condition in which electrical discharge does not occur, the linear relationship remains the same even after the increase of the peak-to-peak voltage beyond the discharge start voltage Tth×2 (V). Thus, it is reasonable to think that this difference is the amount of the increase ΔIac in the AC current Iac, which contributes to the discharge.

Hereafter, α stands for the ratio between the current Iac and the peak-to-peak voltage Vpp which is less than the discharge start voltage Vth×2 (V). Thus, the amount of the AC current other than the AC current attributable to discharge, that is, the current which flows through the area of contact (which hereafter will be referred to as "nip current"), etc., is α.Vpp. Thus, the difference between the Iac measured when a voltage, the peak-to-peak voltage of which is higher than the discharge start voltage Vth×2 (V), and α.Vpp, is defined as "discharge current amount ΔIac" which can be used as the substitute for the amount of discharge:

$$\Delta Iac = Iac - \alpha . Vpp.$$

In a case where the photosensitive drum is charged while the charge voltage or charge current is kept constant, the amount of discharge current is affected by the environmental factors and the cumulative usage of the photosensitive drum and charge roller. This phenomenon occurs because the relationship between the peak-to-peak voltage and discharge current amount, and the relationship between the AC current value and discharge current amount (value), change.

In the case where the charge voltage is controlled so that the AC current remains constant, the charge voltage is controlled so that the total amount of current which flows from a charging member to a member to be charged. As described above, the total amount of current is the sum of the nip current α.Vpp and the amount ΔIac of the current flowed by the discharge which occurs across the area of no contact. Thus, in the case where the charge voltage is controlled so that the AC current remains constant, not only is the discharge current, that is, the very current which is necessary to charge a subject to be charged, but also, the nip current is controlled.

Therefore, the discharge current amount is not actually controlled. That is, even if the charge voltage is controlled so that the charge current remains constant at a preset value, the amount of discharge current naturally reduces if the amount of nip current is increased by the changes caused to the charging member materials by the environmental changes. Further, the reduction in the nip current causes the discharge current to increase. Therefore, even the method for controlling the charge voltage so that the amount of AC current remains constant cannot perfectly prevent the increase or decrease in the amount of the discharge current. Thus, when this method was employed for the longevity of a photosensitive drum, it was difficult to uniformly charge a photosensitive drum while preventing the photosensitive drum from being shaved.

As described above, because of the changes in the electrical resistance, capacity, and materials of an image bearing member, the changes in the electrical resistance, capacity, and materials of a charging member, or the environmental changes, it is difficult to accurately obtain the value of Vth in the discharge start voltage Vth×2 (V). Further, as for the relationship between the peak-to-peak voltage and AC current in the discharge range, as the distance from the discharge start point increases, the discharge current increases in the rate with which it increases, and therefore, the relationship becomes nonlinear.

Based on the discoveries described above, it became evident that it is difficult to precisely obtain the amount ΔIac of the discharge current.

Thus, in order to ensure that the amount of discharge current remains constant at a desired value, the inventors of the present invention controlled a charging apparatus using the following method.

Next, the method for determining the value for the peak-to-peak voltage for a charging apparatus, which keeps the amount of discharge current at a desired amount Ih, will be described.

Figure 6:
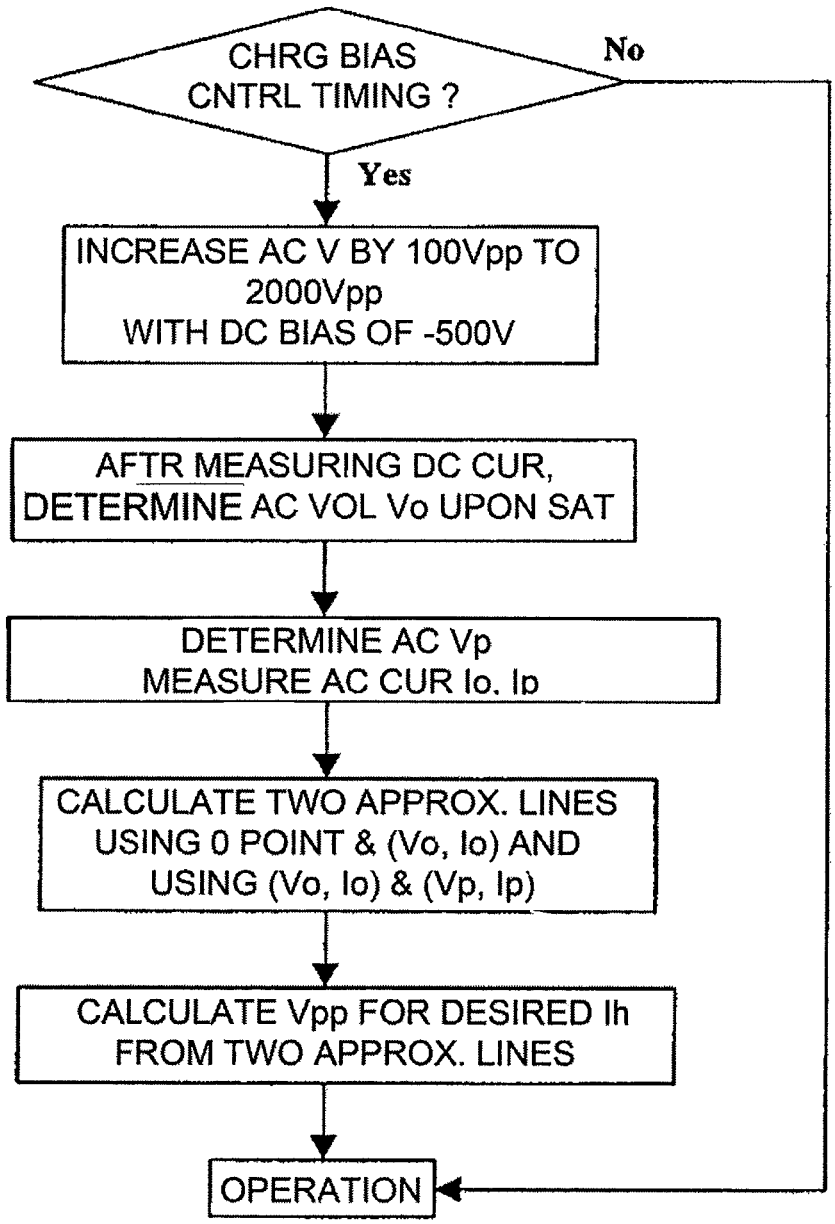
FIG. 6 is a flowchart for describing the charge controlling method in the first preferred embodiment of the present invention.
Figure 7:
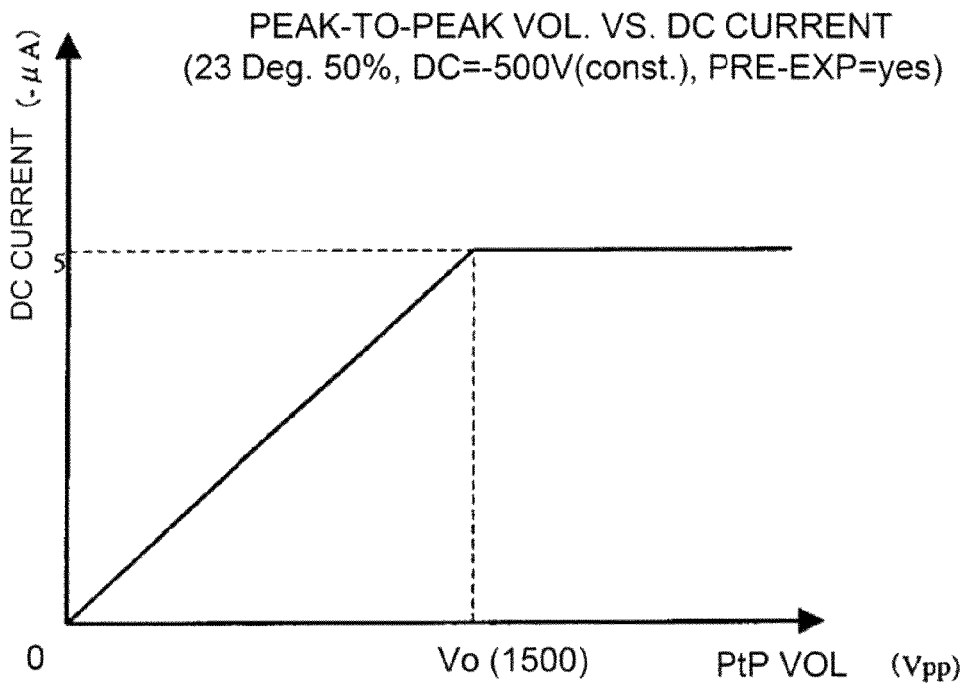
FIG. 7 is a graph for describing the relationship between peak-to-peak voltage and DC current.

Referring to FIG. 6, in this embodiment, multiple test biases, which were different in peak-to-peak voltage, were applied, with preset timing, with the pre-exposure light turned on and the DC voltage kept constant at −500 V, during a period in which no image was formed; the AC voltage was increased (or decreased) in steps, while detecting the DC current value at each voltage level. Then, the AC voltage value, which corresponded to the saturation point of the DC current value, that is, the AC voltage value, above which the rate of change (rate of increase) was below preset value, was defined as the minimum AC voltage value (peak-to-peak voltage V0). Shown in FIG. 7 is the result of the measurements in an environment in which the temperature and humidity were 23° C. and 50%, respectively. As the AC voltage was increased, the DC voltage proportionally increased, reaching −35 μA when the AC voltage was 1,500 Vpp. However, as the AC voltage increased beyond 1,500 Vpp, the rate with which the DC current changed in value suddenly reduced. In this case, the rate with which the DC voltage changed remained at 0.0023=|(DC current value)/AC voltage value)|. In this embodiment, 1,500 Vpp, which was the smallest AC voltage value at which the rate of change fell below 0.0023, was the smallest peak-to-peak voltage V0.

Figure 8:
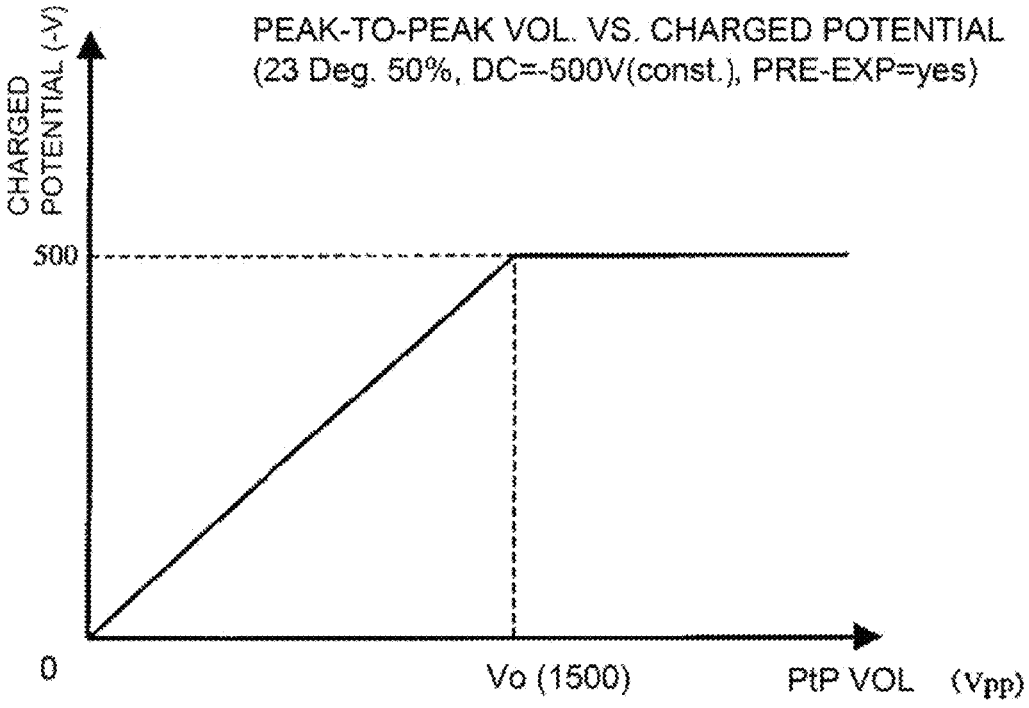
FIG. 8 is a graph for describing the relationship between peak-to-peak voltage and the potential level of the charged object.

Further, as will be evident from FIG. 8, an AC voltage value (point) above which the DC current remained stable in value, was the AC voltage value (point) to which the potential of the charged photosensitive drum 1 converged, and this voltage value V0 corresponded to the discharge start point.

Figure 9:
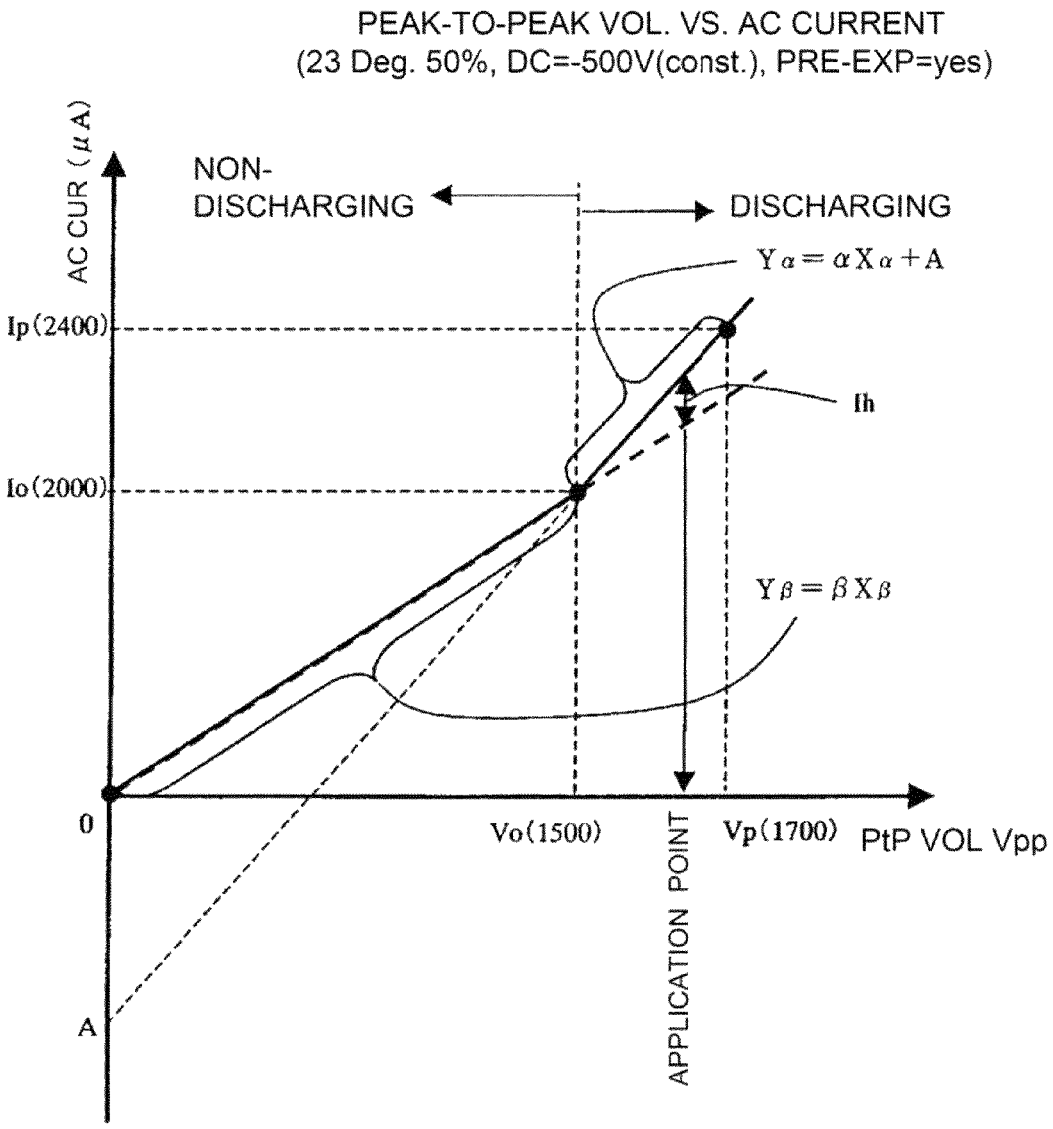
FIG. 9 is a drawing for describing the relationship between the peak-to-peak voltage and AC, regarding the charge controlling method in the first embodiment of the present invention.

Next, a peak-to-peak voltage Vp, which was greater in value than V0 was selected. In this embodiment, 1,700 V was selected as the value for the peak-to-peak voltage Vp. Then, the AC current value was measured when V0=1,500 Vpp, and Vp=1,700 Vpp. Referring to FIG. 9, the measured AC current values were: (V0, I0)=(1,500 Vpp, 2,000 μA), (Vp, IP)=(1,700 Vpp, 2,400 μA).

Next, the relationships between the peak-to-peak voltage and AC voltage, more specifically, the mathematical relationships (function) between the peak-to-peak voltage and AC voltage, was obtained from the above-mentioned measured values. One of the functions is F1 (Vpp) (mathematical relationship between the peak-to-peak and AC current) shows the mathematical relationship between the peak-to-peak voltage level and AC current value when the smallest AC voltage (Vpp), that is, V0, was applied to the charging means. Another is F2 (Vpp), which shows the mathematical relationship between the peak-to-peak voltage level and AC voltage value when a charge voltage which was greater in peak-to-peak value at least by one point than when V0 is applied to the charging means.

That is, for the discharge range, an approximate linear relationship (F2 (Vpp)) is calculated based on the two points (V0, I0) and (Vp, Ip) (Expression 1). For the non-discharge range, an approximate linear relationship (F1 (Vpp)) was calculated, based on the two points (point 0) and (V0, I0) (Expression 2).

In this embodiment, the relationship between the peak-to-peak voltage and AC current was linearly approximated from the above described measured current values, with the use of the least squares method:

function $F2(Vpp))\ Y\alpha=\alpha\times\alpha+A$ (Expression 1 function $F1(Vpp))\ Y\beta=\beta\times\beta$ (Expression 2

Referring to FIG. 9, the amount Ih of the discharge current is the difference between the straight line Yα obtained by approximation, and the straight line Yβ in the non-discharge range obtained by approximation.

$$\begin{aligned} Ih &= F2(Vpp) - F1(Vpp) \\ &= Y\alpha - Y\beta \\ &= (\alpha X\alpha + A) - (\beta X\beta). \end{aligned}$$

Here, assuming that the peak-to-peak voltage value X, which can keep constant the discharge current value Ih, is Vpp, there is the following mathematical relationship:

$$Ih=(\alpha Vpp+A)-(\beta Vpp).$$

Therefore, the value of the peak-to-peak Vpp, which can keep constant the discharge current amount at Ih, can be calculated with the use of the following Expression 3:

$$Vpp=(Ih-A)/(\alpha-\beta) \quad \text{(Expression 3).}$$

Referring to FIG. 9, in this embodiment, when the desired discharge current amount Ih was set to 50 μA, the peak-to-peak voltage value calculated with the use of Expression 3 given above was 1,575 (Vpp).

The control circuit 13 switches the peak-to-peak voltage to be applied to the charging member, to the obtained Vpp, and made the printer to move onto the above described image formation steps (voltage control at Vpp).

As described above, the peak-to-peak voltage value necessary for keeping the discharge current amount constant at a preset value in actual image forming steps, was calculated during each preparatory rotation step, and during the actual printing steps, the charge voltage was kept constant at the voltage level obtained by calculation during the preparatory rotation step. With the employment of this control method, it was possible to absorb fluctuation in the electrical resistance value of the charge roller 2, which is attributable to the non-uniformity in manufacturing processes, changes in the properties of the charge roller materials attributable to the changes in the operational environment, high voltage fluctuation of the main assembly of the image forming apparatus. Therefore, it was possible to reliably keep the discharge current amount constant at a desired value.

When the printer in this embodiment was tested for durability while the charge voltage was controlled with the use of the above described method, the deterioration and shaving of the photosensitive member (as image bearing member) did not occur regardless of the changes in the operational environment. More specifically, the service life of the photosensitive drum was extended roughly 10% compared to when the charging apparatus was controlled with the use of the conventional method in which the charge voltage is controlled so that the AC current amount remains constant. Further, this embodiment made it possible to more accurately calculate the relationship between the peak-to-peak voltage and AC current in the discharge range, than the method proposed in Patent Document 1.

Figure 21:
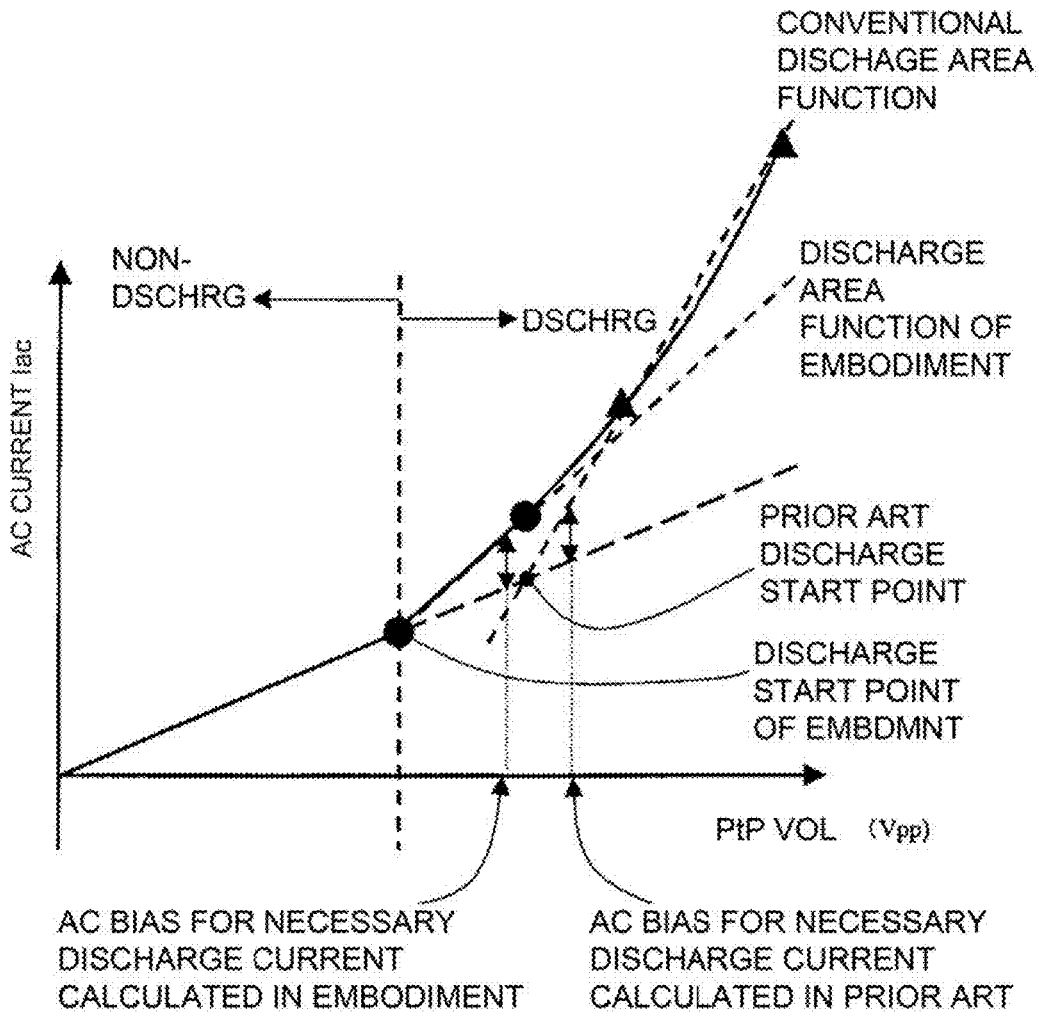
FIG. 21 is a drawing for the comparison between the computation in the conventional discharge current controlling method and that in one of the preferred embodiments of the present invention.

FIG. 21 graphically shows the comparison between the conventional method for setting the discharge current amount, and the method, in this embodiment, for setting the discharge current amount.

In the case of the conventional method, the relationship between the peak-to-peak voltage and AC current is nonlinear in the discharge range. Therefore, the discharge start point obtained by calculation is greater in value than that obtained with the use of the method in this embodiment. In other words, even though the conventional method and the method in this embodiment are the same in the necessary amount of discharge current, the former was greater in the value (Vpp) of the AC bias applied as the charge bias.

The necessary AC bias value (Vpp) for obtaining a desired amount of discharge current, which was calculated with the use of the method in this embodiment was better by as much as 30% compared to the conventional method, in terms of the difference from the actual discharge start point.

In this embodiment, the amount of the discharge current was controlled by switching the magnitude of the peak-to-peak voltage of the AC voltage applied to the charge roller 2. However, this embodiment is not intended to limit the present invention in scope.

For example, the AC current value measurement circuit 14, as an AC current detecting means, in FIG. 4, may be replaced with a peak-to-peak voltage measurement circuit as a peak-to-peak voltage detecting means, so that AC current is applied instead. With this replacement, the peak-to-peak of the AC voltage can be measured to control the AC power source in the amount of AC current output by the control circuit 13 so that AC current is always provided by the amount necessary to provide discharge current by a desired amount during the printing steps.

Further, in this embodiment, the discharge current amount Ih, and the value of the peak-to-peak voltage of the AC voltage applied in the preparatory rotation step, are set in anticipation of a specific operational environment. However, in the case of a printing apparatus provided with an environment sensor (combination of thermometer and hygrometer), it is possible to variably set the value for the peak-to-peak voltage and the value for the discharge current amount, in response to the detected environmental variables, so that the photosensitive drum can be even more reliably and uniformly charged.

As described above, in this embodiment, AC voltage was applied during the preparatory rotation step, while increasing in steps the AC voltage in peak-to-peak voltage. Then, the peak-to-peak voltage value was measured at the lowest AC voltage point (value V0), that is, the point at which the AC current virtually stopped increasing (became stable), and at one or more points in the discharge range, while applying the charge voltage to the charge roller 2. Then, based on the AC current values measured at the above described two or more points, the magnitude for the peak-to-peak voltage of the AC voltage to be applied during the printing steps, was determined, so that the AC voltage, the peak-to-peak voltage of which was suitable for always providing a desired amount of discharge current, or so that the AC current flowed by the AC voltage always supplied the desired amount of discharge current. Thus, not only was it possible to prevent the deterioration and shaving of the photosensitive member, but also, it was possible to uniformly charge the photosensitive member. Therefore, it was possible to prolong the life of the photosensitive member, and also, to improve the printer in image quality.

Further, this embodiment made it possible to absorb the nonuniformity in properties, among charging apparatuses, which was attributable to manufacturing processes. Thus, this embodiment can widen the choice for the materials for a charging apparatus, and also, can lower the level of accuracy with which a charging apparatus is to be manufactured. Thus, this embodiment can reduce the manufacturing cost for a charging apparatus, making it possible to provide a user with a charging apparatus which is substantially lower in cost than a conventional charging apparatus.

(Embodiment 2)

Figure 10:
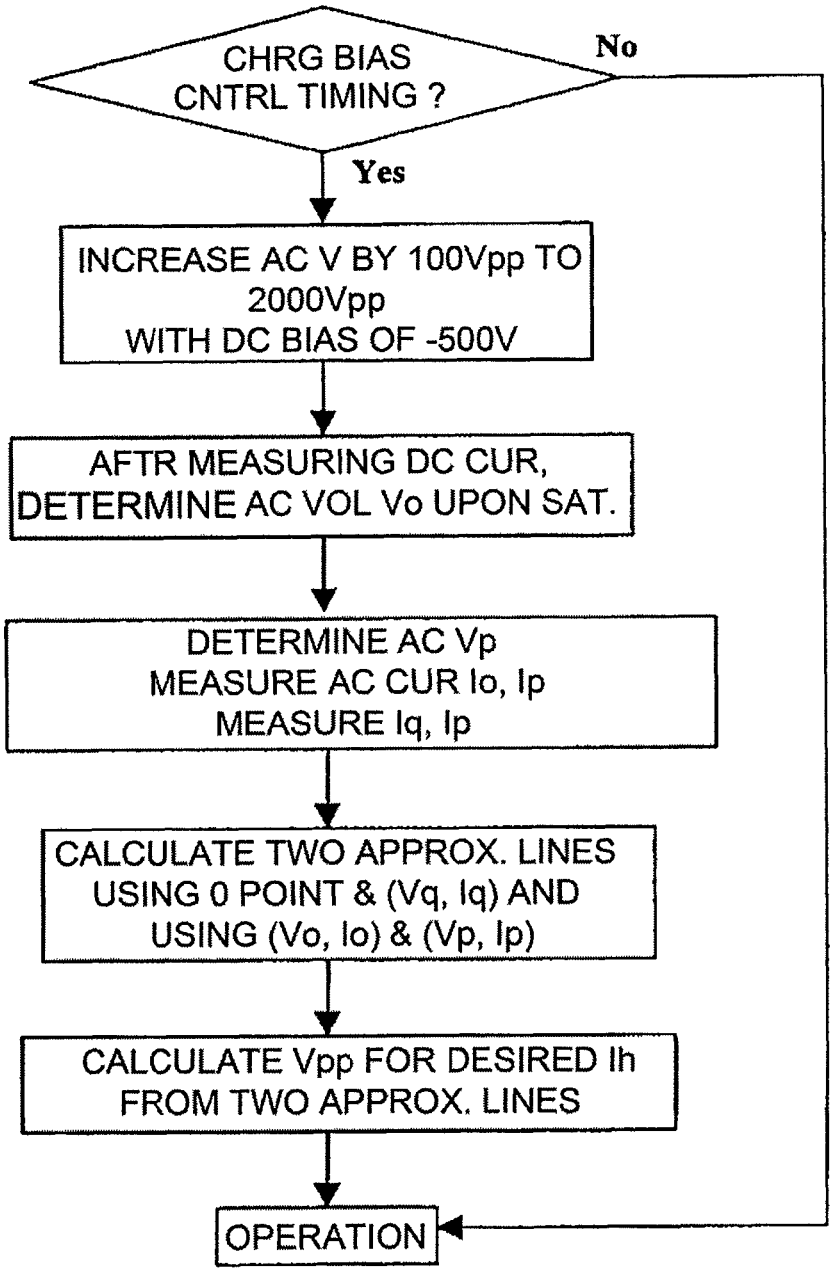
FIG. 10 is a flowchart for describing the charge controlling method in the second preferred embodiment of the present invention.

Referring to the flowchart in FIG. 10, in this embodiment, when the image forming apparatus was on, but not forming an image, the pre-exposure light was turned on, and the DC voltage was kept constant at −500 V, and multiple test biases, which were different in peak-to-peak voltage, were applied. More specifically, the AC voltage was increased (decreased) in steps, and the amount of the DC current was detected at each AC voltage level to find the point beyond which the DC current did not significantly increase (decrease). Then, the AC voltage value corresponding to this point was defined as the smallest value V0 of the AC voltage.

Also in this embodiment, as in the first embodiment, the DC current value changed in the rate of change (rate of increase) at −35 μA, when the AC voltage was 1,500 V in peak-to-peak value, as is shown in FIG. 7 which shows the results of the measurements made in an operational environment in which temperature and humidity were 23° C. and 50%, respectively. In this case, 1,500 Vpp was the value of V0.

Further, as will be evident from FIG. 8, the point at which the DC current became stable in value was the point which corresponded to the potential level to which the potential of the photosensitive drum 1 converged. This point which corresponded to the V0 was the discharge start point.

Next, the peak-to-peak voltage Vp, which was greater in value than the peak-to-peak voltage V0, was selected. In this embodiment, 1,700 Vpp was selected.

Further, the studies made earnestly by the inventor of the present invention revealed that because of the microscopic nonuniformity in the electrical resistance of the materials of the photosensitive member and/or charging member, discharge (abnormal discharge) sometimes occurs when the AC voltage is in the non-discharge range, but is very close to the discharge start point, and therefore, when the equation for the straight line connecting the discharge start point and Point (0, 0) is obtained by approximation, the equation is slightly off in terms of the inclination of the straight line.

Thus, in this embodiment, a peak-to-peak voltage Vq, which is less in value than the peak-to-peak voltage V0, was selected, which was 1,400 Vpp.

Figure 11:
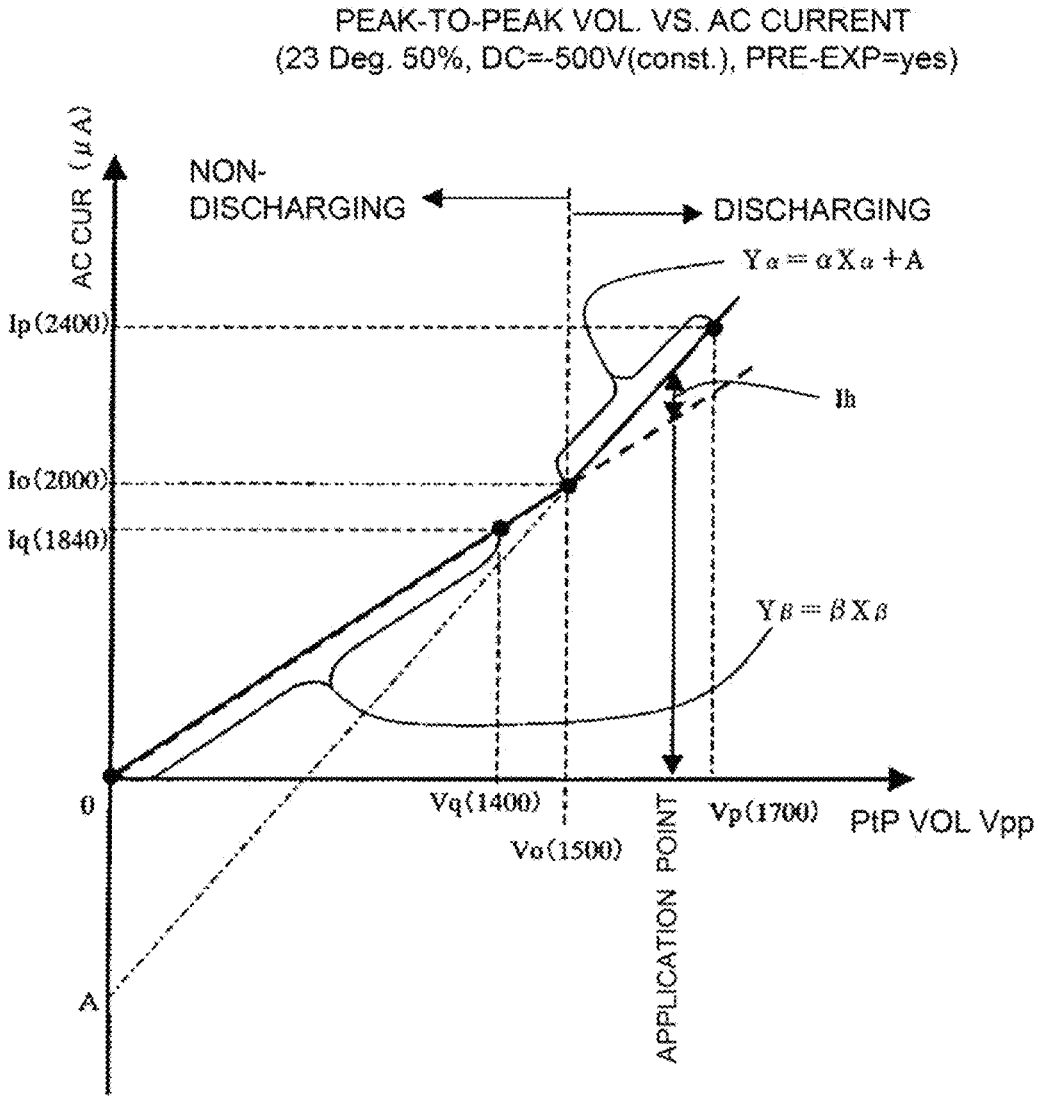
FIG. 11 is a drawing for describing the relationship between the peak-to-peak voltage and AC current, regarding the charge controlling method in the second embodiment of the present invention.

Next, the AC current value was measured at three points, that is, when the peak-to-peak voltage was V0 (=1,500 Vpp), Vp (=1,700 Vpp), and Vq (=1,400 Vpp). Referring to FIG. 11, the measured current values were: (V0, I0)=(1,500 Vpp, 2,000 μA); (Vp, Ip)=(1,700 Vpp, 2,400 μA); and (Vq, Iq)=(1,400 Vpp, 1,840 μA).

Next, from the measured values mentioned above, the relationship between the peak-to-peak voltage and AC current, more specifically, functions which numerically define the relationship between the peak-to-peak voltage and the amount of AC current, was obtained. One of the functions is F1 (Vpp), which numerically defines the relationship between the peak-to-peak voltage and the amount of AC current, based on the relationships between the AC voltage and the amount of AC current, which were obtained when two or more AC voltages, which were lower in peak-to-peak voltage than the AC voltage V0, were applied to the charging means. Another function is F2 (Vpp), which numerically defines the relationship between the peak-to-peak voltage and the amount of AC current, based on the relationships between the AC voltage and the amount of AC current, which were obtained when the AC voltage V0, and two or more AC voltages, which were higher in peak-to-peak voltage than the AC voltage V0, were applied to the charging means.

That is, as for the discharge range, an expression for Function F2 (Vpp), which corresponds to the straight line between the two points (V0, I0) and (Vp, Ip), was approximated (Expression 1). As for the non-discharge range, an expression for Function Fl (Vpp), which corresponds to the straight line approximated from the two p laint points, that is, Point (0, 0) and (Vq, Iq) (Expression 2).

In this embodiment, the relationship between the peak-to-peak voltage and AC current were linearly approximated by the control circuit 13 from the measured current values mentioned above, with the use of the least squares method. That is:

$$\text{Function } F2(Vpp))\ Y\alpha=\alpha\times\alpha+A \quad \text{(Expression 1}$$

$$\text{Function } F1(Vpp))\ Y\beta=\beta\times\beta. \quad \text{(Expression 2}$$

Referring to FIG. 11, the amount Ih of the discharge current is the difference between the approximated straight line Yα, and the approximated straight line Yβ in the non-discharge range.

$$\begin{aligned} Ih &= F2(Vpp) - F1(Vpp) \\ &= Y\alpha - Y\beta \\ &= (\alpha X\alpha + A) - (\beta X\beta). \end{aligned}$$

Here, assuming that the peak-to-peak voltage value, which can keep constant the discharge current value Ih, is Vpp, there is the following mathematical relationship:

$$Ih=(\alpha Vpp+A)-(\beta Vpp).$$

Therefore, the value of the peak-to-peak Vpp, which can keep constant the discharge current amount at Ih, can be calculated with the use of the following mathematical expression:

$$Vpp=(Ih-A)/(\alpha-\beta) \quad \text{(Expression 3).}$$

Referring to FIG. 11, in this embodiment, when the desired discharge current amount Ih was set to 50 μA, the necessary peak-to-peak voltage value was 1,562 (Vpp).

The control circuit 13 switched the value of the peak-to-peak voltage to be applied to the charging member, to the obtained Vpp, and made the printer to move onto the above described image formation steps (AC voltage was kept constant at Vpp).

By structuring the control circuit 13 so that the charge voltage is controlled as described above, the peak-to-peak voltage value necessary for keeping the discharge current amount constant at a desired value can be precisely obtained regardless of the presence of microscopic nonuniformity in the electrical resistance of the materials of the photosensitive member and/or charging member.

(Embodiment 3)

Figure 12:
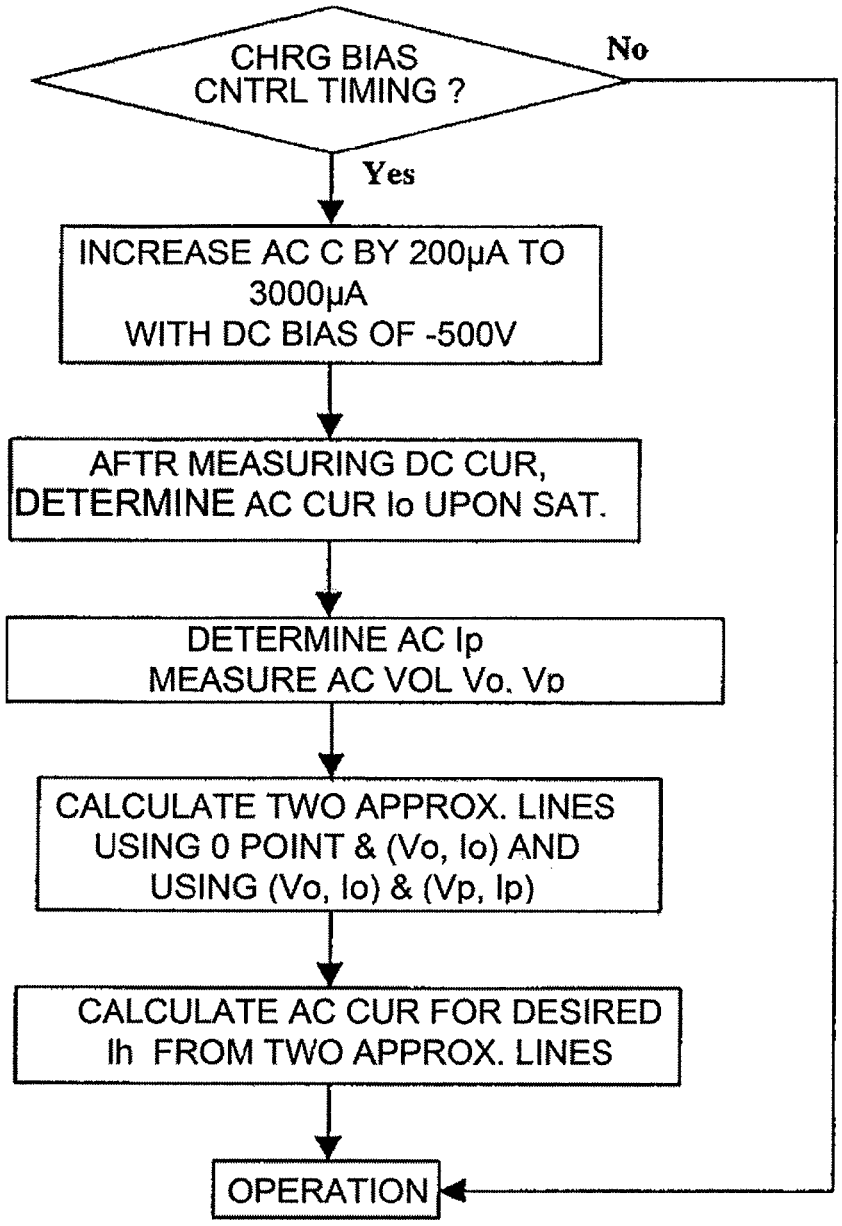
FIG. 12 is a flowchart for describing the charge controlling method in the third preferred embodiment of the present invention.

Referring to the flowchart in FIG. 12, in this embodiment, when the image forming apparatus was on, but not forming an image, the pre-exposure light was turned on, and the DC voltage was kept constant at —500 V, and multiple test biases, which were different in peak-to-peak voltage, were applied. More specifically, the AC current was increased (decreased) in steps, and the amount of the DC current was detected at each AC current level to find the point beyond (below) which the DC current did not significantly increase (decrease). Then, the DC current value corresponding to this point was defined as the smallest value Io for the AC current.

Figure 13:
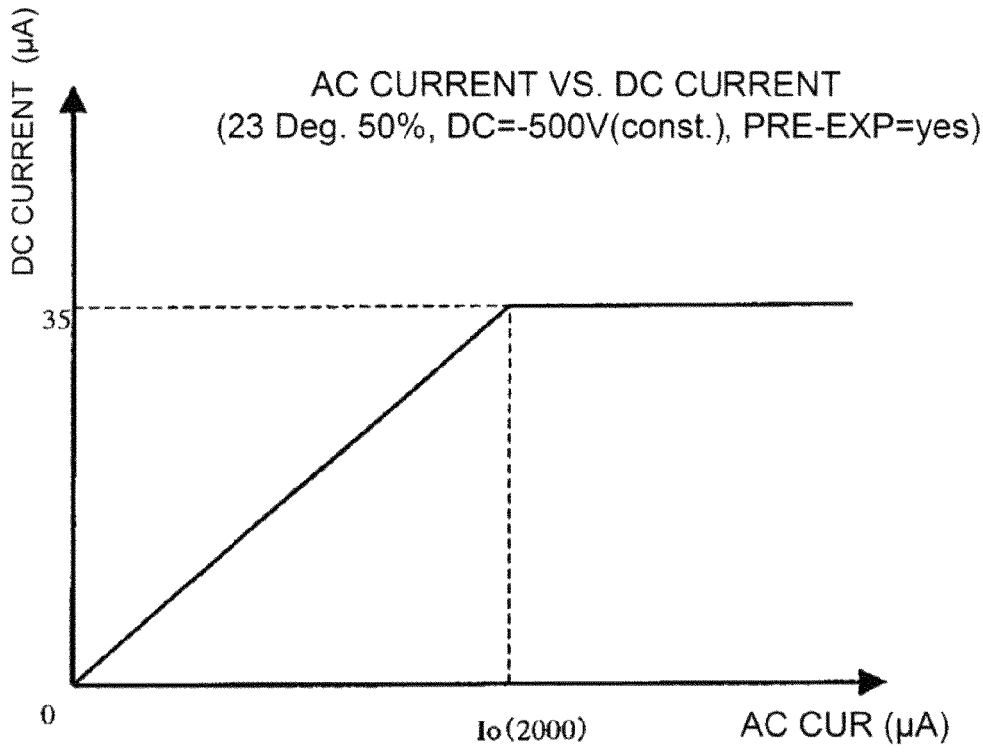
FIG. 13 is a graph showing the relationship between the AC current and DC current.

Referring to FIG. 13, which shows the results of the measurements made in an operational environment in which temperature and humidity were 23° C. and 50%, respectively, when the AC current value was 2,000 μA, the DC current value became smaller in rate of change after it reached −35 μA. In this case, the rate of change (rate of increase) of the DC current value before the DC current value reached 2,000 μA was 0.0175 (=|(DC current value)/(AC current value)|). In this embodiment, therefore, 2,000 μA, that is, the AC current value (smallest value) above which the rate of change of the DC current value was no more than 0.00175, is the value of I0.

Figure 14:
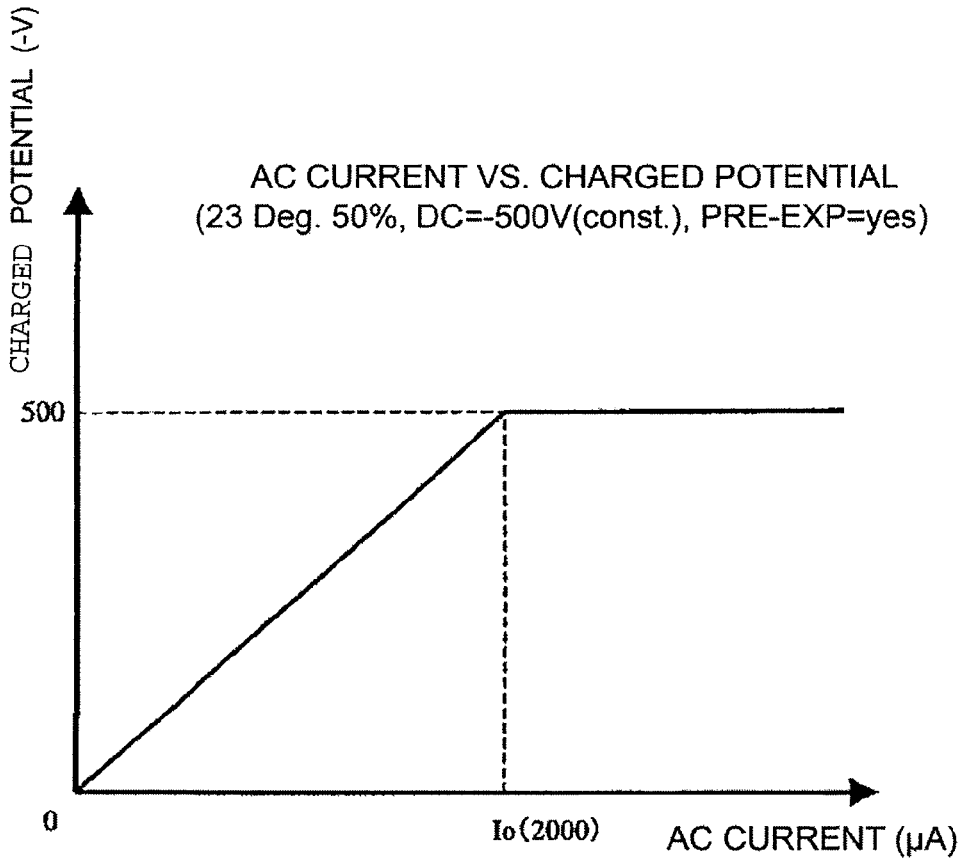
FIG. 14 is a drawing for describing the relationship between the AC current and the potential level of the charged object.

Further, as will be evident from FIG. 14, the point at which the DC current became stable in value is the point which corresponds to the potential level to which the potential of the photosensitive drum 1 converges. This point which corresponds to the I0 is the discharge start point.

Figure 15:
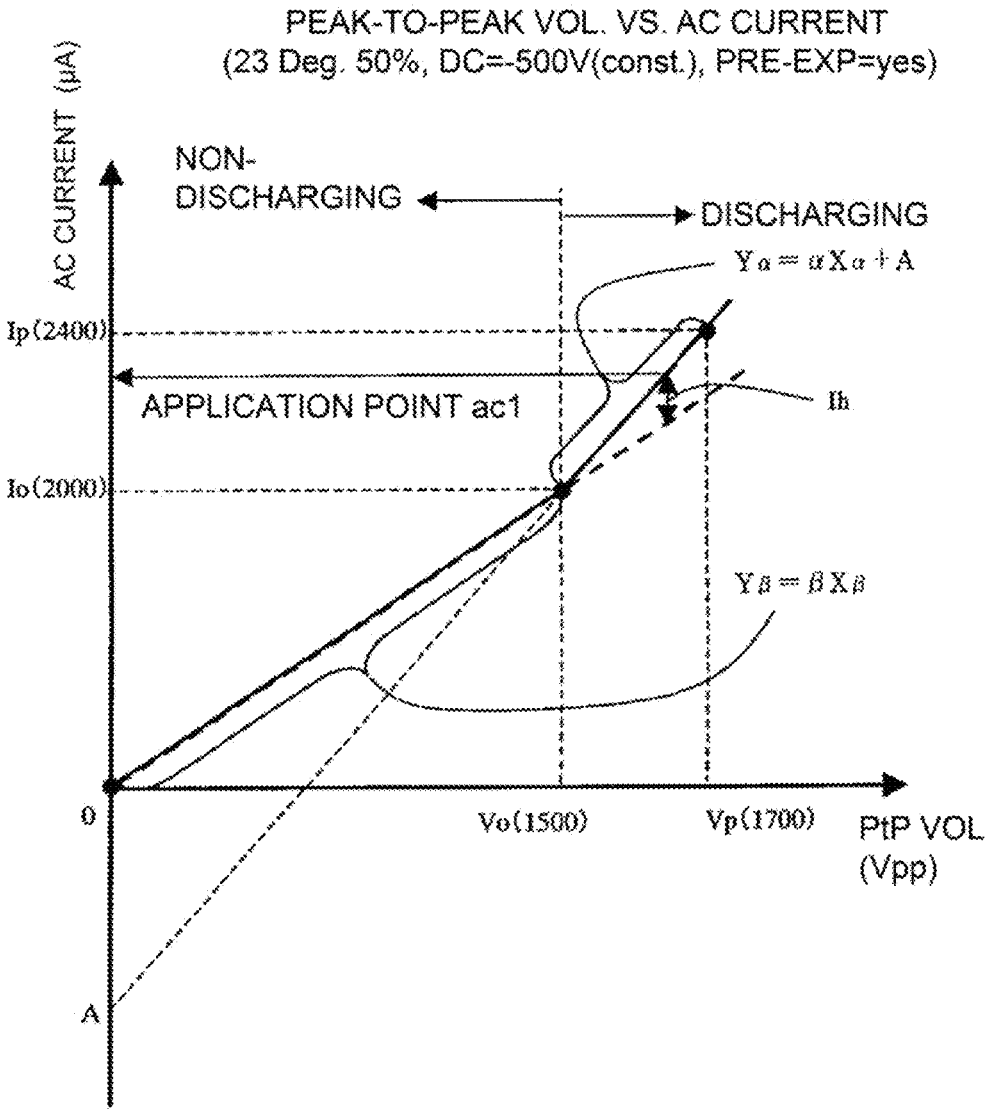
FIG. 15 is a drawing for describing the relationship between the peak-to-peak voltage and AC current, regarding the charge controlling method in the third embodiment of the present invention.

Next, the AC current value Ip, which was greater in value than the AC current value I0 was selected. In this embodiment, 2,400 μA was selected. Then, the peak-to-peak voltage value was measured when the AC current value was I0 (=2,000 μA), and Ip (=2,400 μA). Referring to FIG. 15, the measured peak-to-peak voltage values were: (V0, I0) (1,500 Vpp, 2,000 μA), and (Vp, Ip)=(1,700 Vpp, 2,400 μA).

Next, the relationship between the peak-to-peak voltage and AC voltage, more specifically, numerical relationships between the peak-to-peak voltage and AC current were obtained. One of the numerical relationships is F1 (Vpp) obtained by connecting the point (V0, I0) and point (0, 0) with a straight line. Another one is F2 (Vpp) obtained from the relationship between the AC current value at point (V0, I0) and those at two or more points (Vp, Ip) which were greater in AC current value than point (V0, I0).

That is, as for the discharge range, an expression for Function F2 (Vpp), which corresponds to the straight line between the two points (V0, J0) and (Vp, Ip), was approximated (Expression 1). As for the non-discharge range, an expression for Function Fl (Vpp) was obtained by approximation based on the two points, that is, point (0, 0) and (Vq, Iq) (Expression 2).

In this embodiment, the relationship between the peak-to-peak voltage and AC current were linearly approximated by the control circuit 13 from the measured current values mentioned above, with the use of the least squares method. That is:

$$\text{Function } F2(Vpp))\ Y\alpha=\alpha\times\alpha+A \quad \text{(Expression 1}$$

$$\text{Function } F1(Vpp))\ Y\beta=\beta\times\beta \quad \text{(Expression 2}$$

Here, F2(Vpp)=F1(Vpp)+Ih.

Here, when an AC current value is Iac1, and the corresponding peak-to-peak voltage value is Vpp, Expressions 1 and 2 become:

$$Iac1=\alpha Vpp+A \quad \text{(Expression a)}$$

$$\text{Iac2}=\beta Vpp \quad \text{(Expression b).}$$

Here, Iac2 stands for the AC current value which corresponds to Vpp on approximated straight line Yβ in non-discharge range.

Since discharge current amount Ih is the difference between Iac1 and Iac2, $$Ih=Iac1-Iac2 \quad \text{(Expression c).}$$

From Expressions a and b, AC current value Iac1, which provides discharge current amount Ih, is obtained from the following expression:

$$Iac1=(\alpha Ih-\beta A)/(\alpha-\beta) \quad \text{(Expression 4)},$$

Referring to FIG. 15, in this embodiment, when the desired discharge current amount Ih was set to 50 μA, the necessary amount of AC current was calculated with the use of the equation given above was 2,150 μA.

Then, the control circuit 13 switched the value of the AC current to be supplied to the charging member, to the AC current value Iac1, and made the printer to move onto the above described image formation steps (AC current was kept constant at Iac1)

(Embodiment 4)

Figure 16:
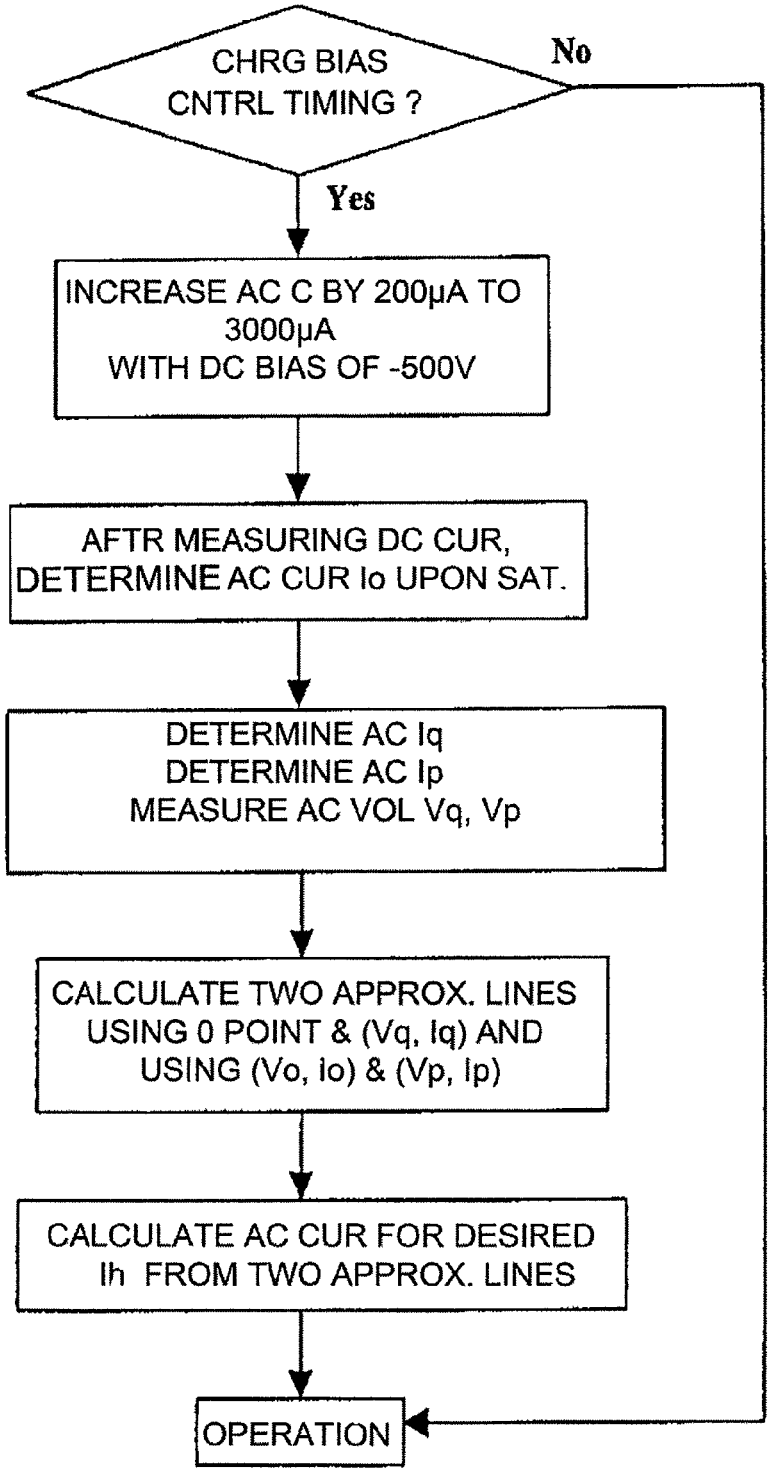
FIG. 16 is a flowchart for describing the charge controlling method in the fourth preferred embodiment of the present invention.

Referring to FIG. 16, in this embodiment, while no image was being formed, the AC current was increased (decreased) in amount in steps by applying multiple test biases different in peak-to-peak voltage, with the pre-exposure light kept on, and the DC voltage kept at —500 V, and the DC voltage current value was detected at each test bias to find out the smallest value I0 of the AC current, beyond which the DC current did not significantly change.

Also in this embodiment, as the AC current value was increased beyond 2,000 μA, the DC current value became stable at −35 μA, as shown in FIG. 13, which shows the results of the measurements in the operational environment in which the temperature and humidity were 23° C. and 50%, respective, as they were in the third embodiment. In this case, 2,000 μA is the value of I0.

Further, as will be evident from FIG. 14, the point which corresponds to the DC current value beyond which the DC current is stable in amount is the point which corresponds to the potential level to which the charge of the photosensitive drum 1 converges. Thus, this Io is the discharge start current value (point).

Further, the studies earnestly made by the inventors of the present invention revealed that even in the non-discharge range, electrical discharge occurs in the adjacencies of the discharge start point, because of the microscopic nonuniformity of the materials of the photosensitive member and/or charging member, in terms of electrical resistance, although the occurrence is very rare. Thus, when approximating the straight line which connects the discharge start point and zero point, there occurs a slight deviation in inclination.

In this embodiment, therefore, AC current value Iq, which is smaller than AC current value I0 was selected, which was 1,800 μA.

Further, AC current value Ip, which was greater than AC current value I0, was selected, which was 2,400 μA.

Figure 17:
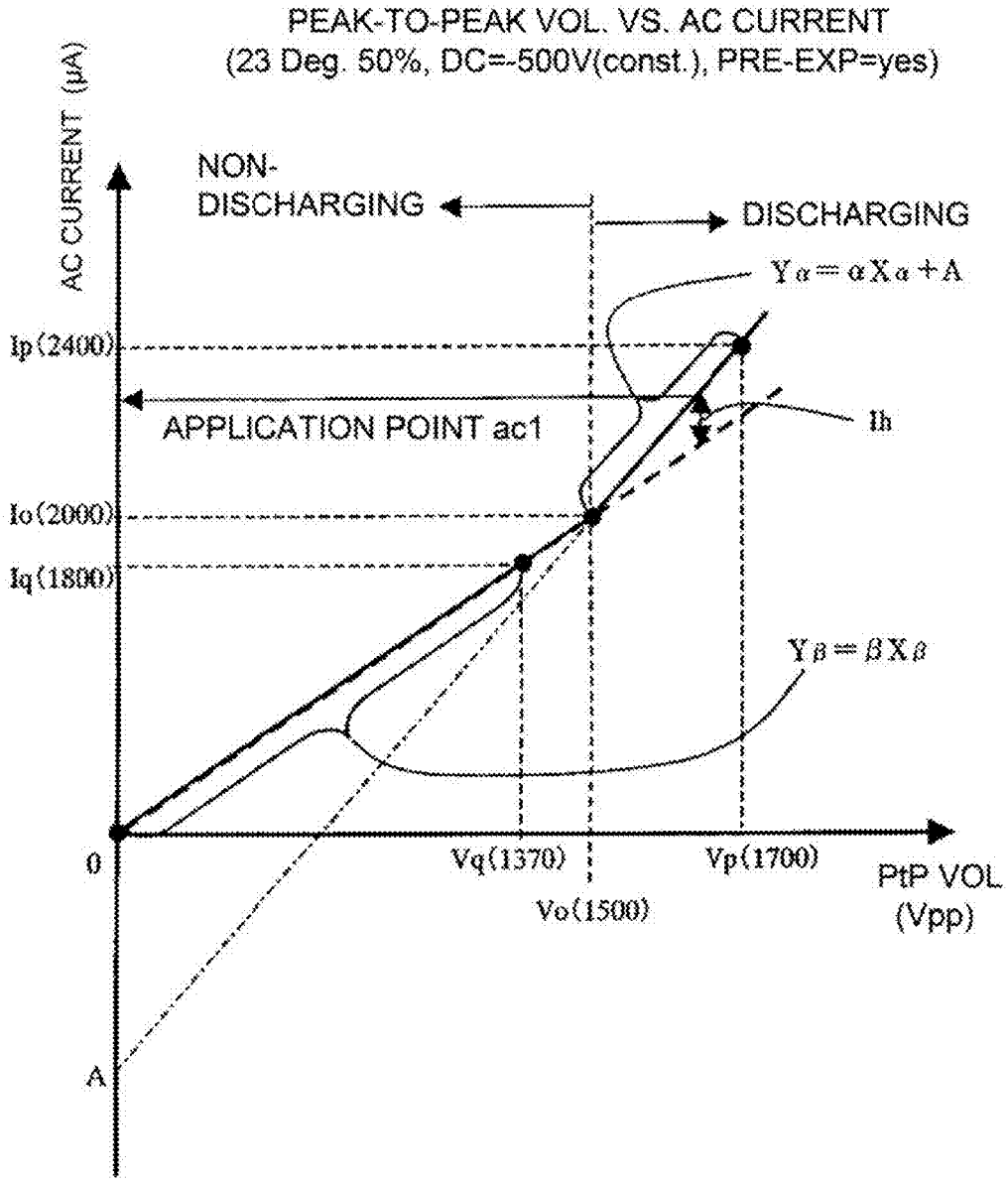
FIG. 17 is a drawing for describing the relationship between the peak-to-peak voltage and Ac current, regarding the charge controlling method in the fourth embodiment of the present invention.
Figure 18:
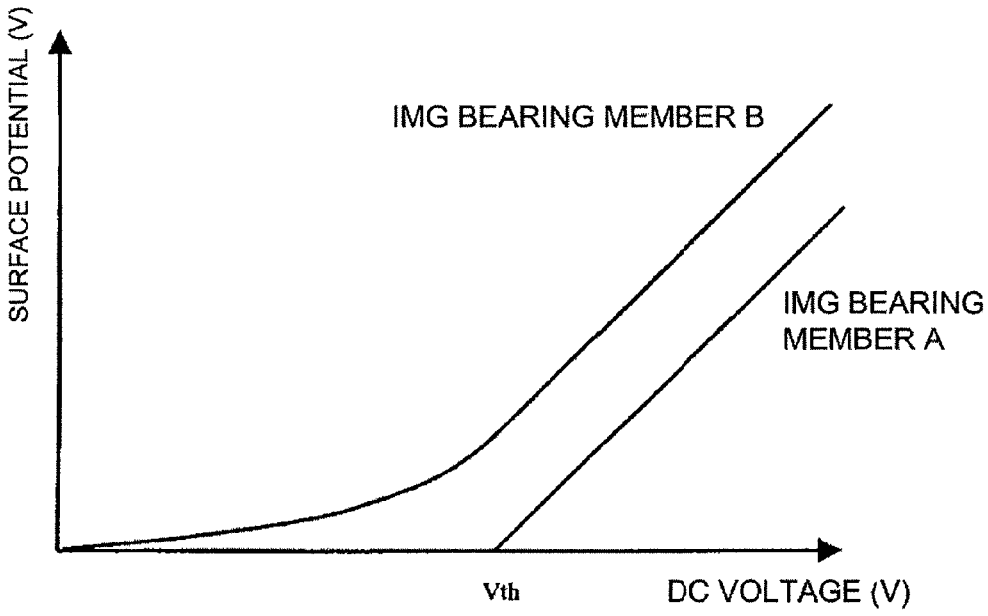
Fig. 18 PRIOR ART
FIG. 18 is a drawing for describing the relationship between the DC voltage and surface potential of the charged object, regarding one of the conventional DC charging methods.
Figure 19:
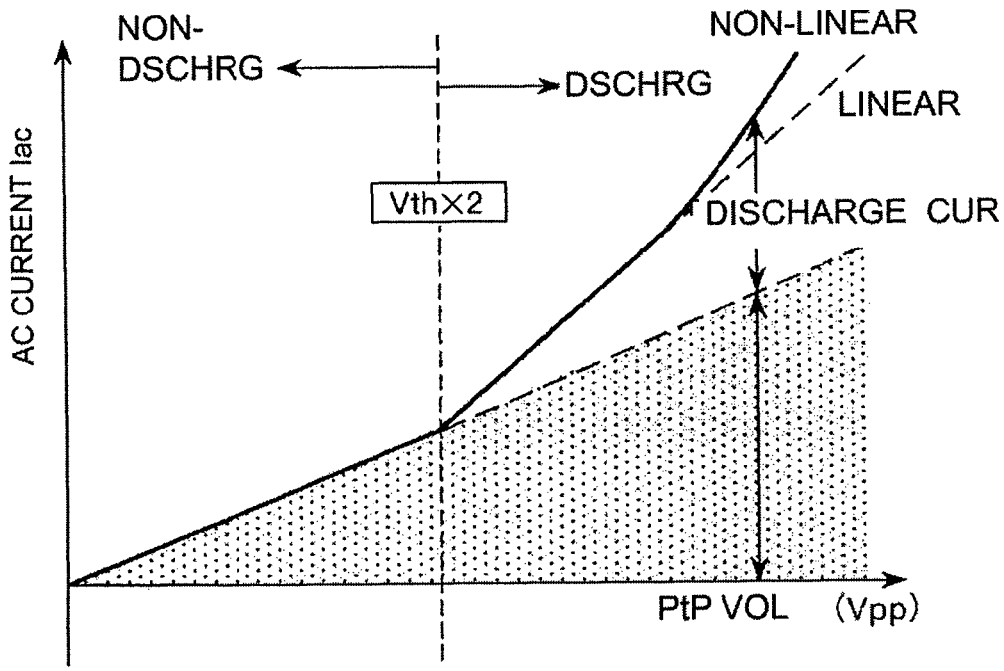
Fig. 19 PRIOR ART
FIG. 19 is a graph which roughly shows the relationship between the measured amount of discharge current and peak-to-peak voltage, regarding the conventional charging apparatus (charge controlling method).
Figure 20:
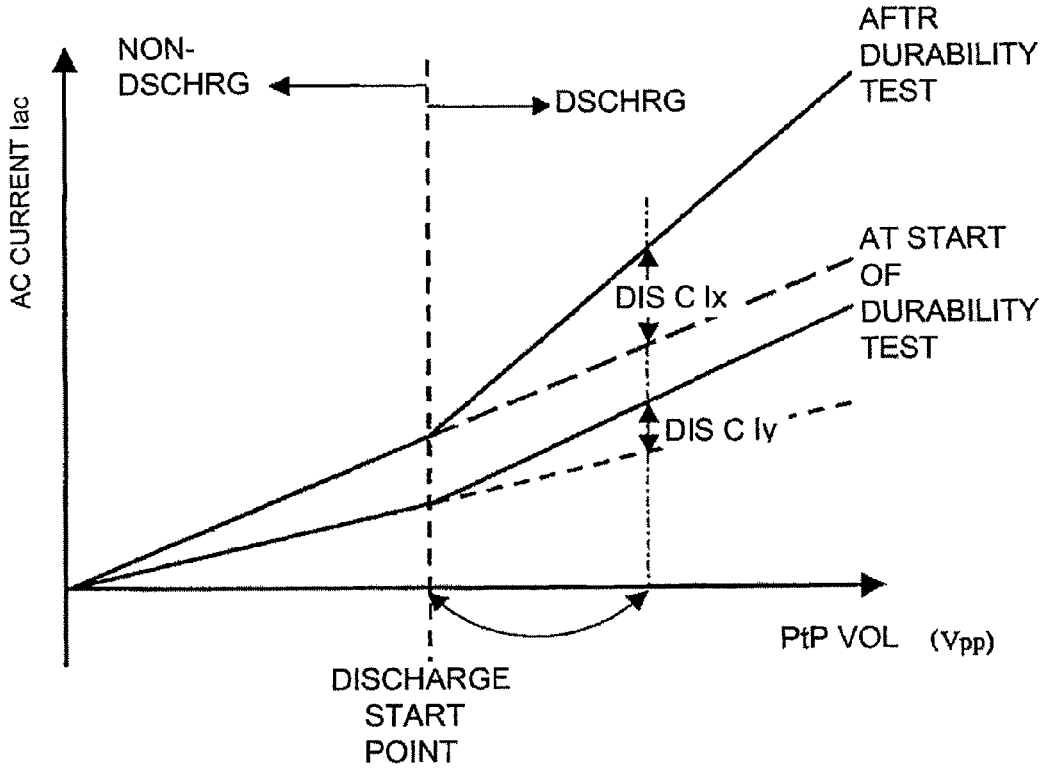
Fig. 20 PRIOR ART
FIG. 20 is a drawing which describes the relationship between the peak-to-peak voltage and AC current, regarding the conventional charging apparatus (charge controlling method).

Then, the peak-to-peak voltage was measured when the AC current value was I0 (=2,000 μA), Ip (=2,400 μA), and Iq (=1,800 μA). The measured values of the peak-to-peak voltage were (V0, I0)=(1,500 Vpp, 2,000 μA), (Vp, Ip)=(1,700 Vpp, 2,400 μA), and (Vq, Iq)=(1,370 Vpp, 1,800 μA) as shown in FIG. 17.

Next, the relationship between the peak-to-peak voltage and AC current, more specifically, numerical relationships between the peak-to-peak voltage and AC current, were obtained from the measured values given above. One is the numerical expression for Function F1 (Vpp) obtained from the relationship between the values of the peak-to-peak voltage measured at one or more points at which the AC current was smaller in value than when AC current value Io was flowed to the charging means. Another one is the numerical expression for Function F2 (Vpp) obtained from the relationship between the values of the peak-to-peak voltage measured at the point at which the AC current value was I0, and at least one point where the AC current value is greater than I0.

That is, in the case of the discharge range, the straight line is approximately calculated based on two points (V0, I0) and (Vp, Ip) (F2) (Vpp) (Expression 1). In the case of the non-discharge range, the numerical expression for the straight line was approximated from (0, 0) and (Vq, Iq) (F1) (Expression 2).

In this embodiment, the relationship between the peak-to-peak voltage and AC current was linearly approximated by the control circuit 13 from the two points (V0, I0) and (Vp, Ip), with the use of the least squares method. That is:

$$\text{Function } F2(Vpp))Y\alpha=\alpha\times\alpha+A \quad \text{(Expression 1}$$

$$\text{Function } F1(Vpp))Y\beta=\beta\times\beta \quad \text{(Expression 2}$$

Here, F2(Vpp)=F1(Vpp)+Ih.

Here, when an AC current value is Iac1, and the corresponding peak-to-peak voltage value is Vpp, Expressions 1 and 2 become:

$$Iac1=\alpha Vpp+A \quad \text{(Expression a)}$$

$$\text{Iac2}=\beta\text{Vpp} \quad \text{(Expression b).}$$

Here, Iac2 stands for the AC current value which corresponds to Vpp on approximated straight line Yβ in non-discharge range.

Since discharge current amount Ih is the difference between Iac1 and Iac2, $$Ih=Iac1-Iac2 \quad \text{(Expression c).}$$

From Expressions a and b, AC current value Iac1, which provides discharge current amount Ih, is obtained from the following expression:

$$Iac1=(\alpha Ih-\beta A)/(\alpha-\beta) \quad \text{(Expression 4).}$$

Referring to FIG. 17, in this embodiment, when the desired discharge current amount Ih was set to 50 μA, the necessary amount of AC current was calculated with the use of the equation given above was 2,123 μA.

Then, the control circuit 13 switched the value of the AC current to be supplied to the charging member, to the AC current value Iac1, and made the printer to move onto the above described image formation steps (AC current was kept constant at Iac1).

With the provision of the control structure described above, it was possible to precisely obtain a desired amount of discharge current, regardless of the presence of nonuniformity in microscopic level in the electrical resistance among photosensitive members and/or charging members.

(Miscellanies)

In the preferred embodiments described above, Point (0, 0) was used to approximate the straight line in the non-discharge range. However, a point other than Point (0, 0) may be used. That is, as long as the amount of the current which flows at a point when the peak-to-peak voltage at this point is Vpp can be known in advance, this point and another point of measurement can be used to obtain the relationship between the peak-to-peak voltage and AC current.

Also in the preferred embodiment, the number of the points (V, I) of measurement, beside the discharge start point, was minimum (one). However, the number of the points of measurement may be two, three, or more. In any case, the discharge current amount can be easily obtained by approximating the linear relationship between the peak-to-peak voltage and discharge current, with the use of the least squares method, for example.

The multiple AC voltages different in peak-to-peak voltage, which were applied to the charging means in the order of the magnitude of their peak-to-peak voltage, to measure the AC current value while no image was formed, may be changed according to the image formation count, operational environment, thickness of the film(s) of an image bearing member, or at least one of the DC current values detected by the DC current detecting means. Similarly, the multiple AC currents different in value, which were flowed through the charging means in the order of their current value, to measure the peak-to-peak voltage values while no image was formed, may be changed according to the image formation count, operational environment, thickness of the film(s) of an image bearing member, or at least one of the DC current values detected by the DC current detecting means.

Further, the amount Ih of the discharge current can be changed according to the image formation count, operational environment, thickness of the film(s) of an image bearing member, or at least one of the DC current values detected by the DC current detecting means. That is, in the preceding embodiments, the discharge current amount Ih, the value of the alternating electric field to which the charging member is subjected during the preparatory rotation step, were variable according to the environmental factors detected by the environment sensor 16. However, the method for detecting the film thickness of a photosensitive member from the DC current value has been widely known, and it is also effective to design a charging apparatus so that the discharge current amount Ih, and the value of the alternating electric field to be applied during the preparatory rotation step, can be changed according to the detected thickness of the film(s) of a photosensitive member and the detected DC current value. Further, it is also effective to design the charging apparatus so that the cumulative image formation count is stored, and the discharge current amount Ih, and the value of the alternating electric field to be applied during the preparatory rotation step, can be changed according to the stored cumulative image formation count.

Further, in each of the above described preferred embodiments, the programs for determining, by computation, the proper value for the peak-to-peak voltage for the AC voltage to be applied in the charging step of the printing step, were carried out during the preparatory rotation step, that is, one of the steps in which no image was formed by the printer. The steps in which the programs are to be carried out does not need to be limited to the one in the preceding embodiments. That is, the programs may be carried out in any, or two or more, of the steps in which no image is formed, for example, the startup rotation step, paper intervals, or post-rotation step.

Further, in each of the preferred embodiments described above, the image forming apparatus was provided with a cleaning member. However, the present invention is also applicable to the charge process controlling means of a so-called cleaner-less image forming apparatus, that is, an image forming apparatus which has no cleaning member, and cleans its photosensitive member with its developing apparatus at the same time as it develops a latent image with the developing apparatus. Such an application brings forth the same effects as those provided by the preferred embodiments.

Further, the photosensitive drums 1 in each of the preceding embodiments may be replaced with a photosensitive drum of the direct injection type, which is provided with a charge injection layer, the surface electrical resistance of which is in the range of $10^9$-$10^{14}$ Ω.cm Even in the case of a photosensitive drum having no charge injection layer, effects similar to those obtainable with the above-mentioned photosensitive member with a charge injection layer can be obtained as long as the electrical resistance of its charge transfer layer is within the abovementioned range. Further, instead of the photosensitive drum 1 in the above-described embodiments, a photosensitive member which is made of amorphous silicon, and the volumetric resistance of the surface layer of which is roughly $10^{13}$ Ω.cm, may be used.

Also in each of the above described embodiments, a charge roller was used as a flexible charging member of the contact type. However, in place of the charge roller, a charging member different in shape and/or material, for example, a fur brush, a piece of felt or fabric, etc., may be used. Further, a charging member, which is better in elasticity, electrical conductivity, surface properties, durability, etc., may be obtained by using in combination various substances as the materials for a charging member.

As for the waveform for the alternating voltage component (AC component: voltage which periodically change in value) to be applied to the charge roller 2 and development sleeve 4*b*, any of the sinusoidal form, rectangular form, triangular form, etc., may be used as fit. Further, the alternating component of the AC voltage may be created by periodically turning on and off a DC power source. In such a case, the waveform of the AC component is rectangular.

Also in each of the above described preferred embodiments, the exposing apparatus 3 used as the means (information writing means) for exposing the charged portion of the peripheral surface of the photosensitive drum 1 was a laser scanner. However, the exposing means may be a digital exposing means made up of an array made up of light emitting elements in solid state, for example, LEDs, or an analog image exposing means, the original illuminating light source of which is a halogen lamp, a fluorescent lamp, or the like.

Also in each of the above described preferred embodiments, the first image bearing member was the photosensitive member 1. However, the first image bearing member may be an electrostatically recordable dielectric member or the like. In the case where the first image bearing member is an electrostatically recordable dielectric member, first, the surface of the electrostatically recordable dielectric member is uniformly charged, and then, an electrostatic latent image which reflects the information of a target image is written by selectively discharging numerous points of the charge surface of the dielectric member with the use of a charge removing means, such as a charge removing needle head, an electron gun, and the like.

Also in each of the above described preferred embodiments, a transfer roller was used as the transferring means. However, the transferring means may be a transfer blade, transfer belt, or any other transferring means of the contact type. Further, it may be of the non-contact type, which uses a corona-based charging device.

Also in each of the above described preferred embodiments, the image forming apparatus was of such a type that directly transfers onto a recording medium, a monochromatic toner image formed on its photosensitive drum. However, the preferred embodiments are not intended to limit the present invention in scope. That is, the present invention is also applicable to a monochromatic image forming apparatus which employs an intermediary transferring member, such as a transfer drum or a transfer belt, and a full-color (multicolor) image forming apparatus which forms a multicolor or a full-color image by transferring in layers multiple monochromatic images.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 178505/2008 filed Jul. 8, 2008 which is hereby incorporated by reference.

What is claimed is:

1. A charging apparatus comprising:

a charging member contacting an image bearing member to charge the image bearing member;

an applying device configured to apply to said charging member a charging bias voltage including a DC voltage component and an AC voltage component;

an AC detector for detecting an AC current flowing to said charging member;

a DC detector for detecting a DC current flowing to said charging member;

wherein the charging apparatus is operable in a mode for determining a peak-to-peak voltage of the AC voltage to be applied to said charging member during an image forming operation on the basis of a first detection result detected by said AC detector when at least an AC voltage having a first peak-to-peak voltage is applied to said charging member and a second detection result detected by said AC detector when an AC voltage having a second peak-to-peak voltage larger than the first peak-to-peak voltage is applied to said charging member; and a controller for controlling the first peak-to-peak voltage during the operation in the mode so as to be smaller than a peak-to-peak voltage Vo of the AC voltage at which a detection result of said DC detector starts saturating when the peak-to-peak voltage of the AC voltage applied to said charging member is increased, and for controlling the second peak-to-peak voltage during the operation in the mode so as to be larger than Vo.

2. An apparatus according to claim 1, wherein in the mode, the peak voltage value of the AC voltage to be applied to said charging member during an image forming operation is set such that a difference between, (1) a first relational expression provided on the basis of (i) a first AC current flowing through said charging member when the peak-to-peak voltage of the AC voltage applied to said charging member is zero and (ii) a second AC current flowing through said charging member when the peak-to-peak voltage of the AC voltage applied to said charging member is the first peak-to-peak voltage, and (2) a second relational expression provided on the basis of (i) a third AC current flowing through said charging member when the peak-to-peak voltage of the AC voltage applied to said charging member is Vo and (ii) a fourth AC current flowing through said charging member when the peak-to-peak voltage of the AC voltage applied to said charging member is the second peak-to-peak voltage is a predetermined target value.

* * * * *